US006569072B1

(12) United States Patent
Rupp et al.

(10) Patent No.: US 6,569,072 B1
(45) Date of Patent: May 27, 2003

(54) PARTITION MANUFACTURING METHOD AND APPARATUS

(75) Inventors: Phillip Dale Rupp, Olympia, WA (US); Michael D. Riley, Tumwater, WA (US); David P. Herigstad, Edmonds, WA (US); George Walter Herigstad, Olympia, WA (US)

(73) Assignee: Kay Packaging Company, Inc., Lacey, WA (US)

( * ) Notice: Subject to any disclaimer, the term of this patent is extended or adjusted under 35 U.S.C. 154(b) by 0 days.

(21) Appl. No.: 09/457,910

(22) Filed: Dec. 8, 1999

(51) Int. Cl.[7] ..... B31B 11/00

(52) U.S. Cl. ..... 493/90; 493/91; 493/92; 493/350; 493/391; 493/957

(58) Field of Search ..... 493/91, 84, 92, 493/90, 374, 379, 391, 13, 10, 67, 340, 350, 353, 14, 957

(56) References Cited

U.S. PATENT DOCUMENTS 3,350,836 A * 11/1967 Dillon et al.
3,685,401 A 8/1972 Peters
3,690,225 A * 9/1972 Monaco et al.
3,691,859 A 9/1972 Peters
3,728,925 A 4/1973 Peters
3,998,136 A * 12/1976 Peters, Jr.
4,019,427 A * 4/1977 Down et al.
4,170,170 A * 10/1979 Beasely et al.
4,170,171 A * 10/1979 Beasley
4,170,928 A * 10/1979 Beasley et al.
4,996,821 A * 3/1991 Crowe et al.
5,601,521 A * 2/1997 Xapelli

OTHER PUBLICATIONS

Split Cam Design flyer by Warner Electric disclosing prior art clutch brake, (flyer undated, but prior art).

* cited by examiner

*Primary Examiner*—Eugene Kim
(74) *Attorney, Agent, or Firm*—Klarquist Sparkman LLP

(57) ABSTRACT

A partition making apparatus includes a first card material supply module, a first card forming module including a slot former, a singulator and a card transporter. The first card forming module also includes a feeder for advancing a band of first card forming material at least partially through the first module. The first module may include a transporter which shifts singulated first cards from a first location to a card delivery location with a card transferor shifting sets of first cards to be included in an assembled partition from the first card forming module to an assembly station. The sets of first cards may be advanced along a conveyor included in the assembly station to a second card insertion location. The second card material supply module provides a band of second card forming material to a second card forming module. A second card forming module includes a slot former for slotting the second cards, a second card singulator for severing the band of second card forming material into individual second cards and a second card material feeder moves the band of second card forming material through the second module. Singulated second cards are inserted into the slots of the first cards at the assembly station.

61 Claims, 11 Drawing Sheets

FIG. 4
| | | |
|---|---|---|
| 1 | LONG HEIGHT | #–.#–––· |
| 2 | NO L CARDS | #–. |
| 3 | L INSIDE CELL | #–.#–––· |
| 4 | SHORT HEIGHT | #–.#–––· |
| 5 | NO S CARDS | #–. |
| 6 | BUNDLE COUNT | #–. |
| 7 | BAR SPACING | #–. |
| 8 | CELL NO. TO NIP | #–. |
FIG. 5
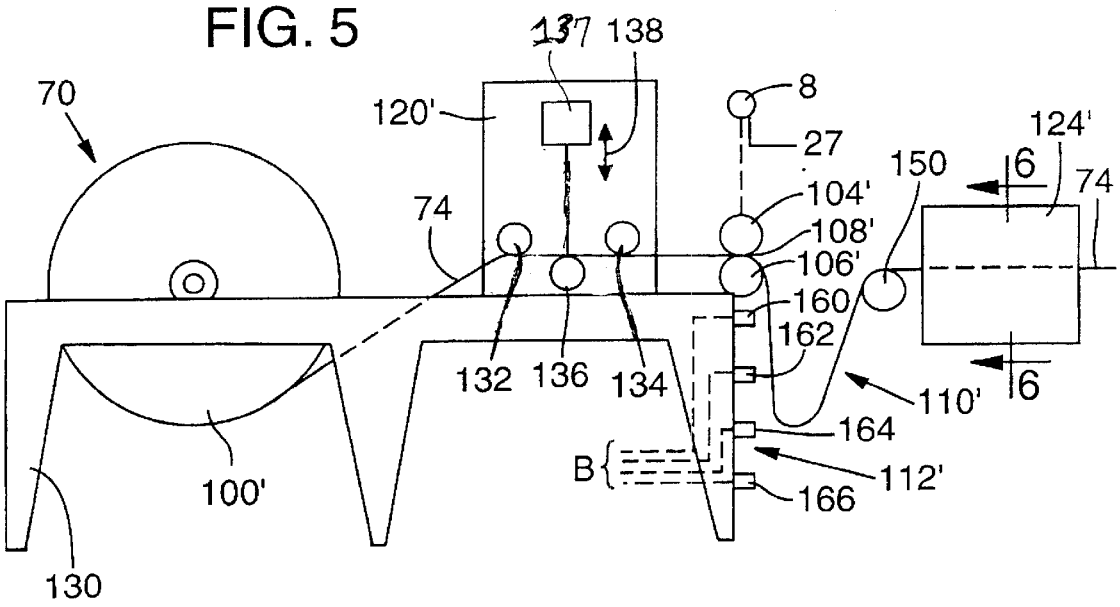
FIG. 6
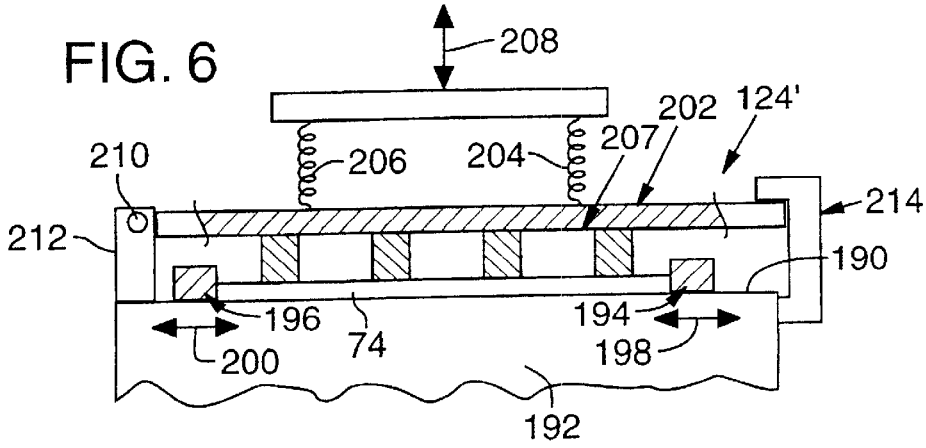

PARTITION MANUFACTURING METHOD AND APPARATUS

BACKGROUND

The present invention relates to an apparatus for making partitions for containers and to components of such an apparatus.

Divider structures or partitions for containers are known and commonly employ slotted interlocking cards or strips which, when interconnected, define cells for receiving objects such as bottles, containers or other items and for separating the objects from one another within a box or other structure. For example, two cards may be interlocked with one another and when positioned orthogonal to one another in a box and together with the walls of the box, define four cells for receiving objects. The partitions may be made of any number of first cards in a set of first cards and any number of second cards in a set of second cards, which the sets of first and second cards interfitting with and typically being orthogonal to one another when the partition is in use in a container.

The partition structures formed of the sets of first and second cards typically may be collapsed together when not installed in a box or other container so that the first and second cards forming the partition structure extend generally in the same direction. Conversely, when in use the first and second cards typically extend at right angles to one another. The first and second cards may be different from one another, for example the first cards may be longer than the second cards, but in some cases, for example when a partition structure is to be used with a square box or case, the first and second cards may be identical in length.

In general, it is desirable to minimize the cost of partitions since they are typically disposed of or recycled following their use. Consequently, those who pack bottles or other objects into partition structure containing boxes naturally do not want to spend more money than necessary on these partition structures.

In a common approach, partition structures have been manufactured utilizing a series of separate operations. These separate operations have including the separate formation of the first sets of partition strips, the separate formation of the second sets of partition strips, and the separate assembly of these partition strips. It is common for separate pieces of equipment to be employed for each of the separate operations with labor being required to transfer the first and second cards from the location where they are formed to an assembly location.

A single pass partition manufacturing machine disclosed in U.S. Pat. No. 3,685,401 to Peters, which is incorporated herein in its entirety by reference, is also known. In this machine, the first and second types of partition strips are manufactured and delivered to an assembly location of the machine where the partitions or divider structures are assembled. By single pass, it is meant that the same machine manufactures both types of partition cards and assembles them. U.S. Pat. Nos. 3,691,859 and 3,728,925 to Peters disclose components which may be included in such a partition manufacturing machine.

Although the Peters' approach offers some advantages over approaches wherein first partition strips and second partition strips are formed at separate locations and in a separate operation from a divider structure assembly operation, a need nevertheless exists for an improved partition manufacturing apparatus and in components useful in such an apparatus.

SUMMARY

In accordance with one aspect of an embodiment of the present invention, an apparatus is disclosed for making partitions for containers. The partitions each have a first set of first cards and a second set of second cards. The first set includes at least one first card having at least one first card slot, and typically includes two or three of the first cards each with a number of slots which corresponds to the number of second cards in the second set which is to be included in the partition. The second set includes at least one second or crosscard having at least one second card slot. More specifically, the second set typically includes two or three cards with each second crosscard of the set having a number of slots which corresponds to the number of first cards included in the set of first cards which is to be assembled with the second cards into the partition. The slots of the first and second cards interfit with one another, in a conventional manner to form a partition. For convenience, the first cards may sometimes herein be called long cards and the second cards may be called short cards or crosscards even though the first cards may be of the same length as the second cards. Again, the number of cards of each type included in the partition may be varied with a typical maximum number of cards being three long cards and five short cards, although this is subject to change depending upon the partition that is being assembled.

A first embodiment of a partition manufacturing apparatus may include a first card stock supplier adapted to deliver an elongated first band of first card stock forming material from a first roll of such material. The first stock supplier typically includes a first card stock advancer which is adapted to advance the first band from the first roll. A first slot former is adapted to repetitively engage the first band and cut the first card slots in successive sections of the first band. Each slotted section corresponds to a portion of the first band from which a respective individual first card is to be formed.

Although multiple first band feeders may be used, at least one first band feeder may be provided in this embodiment and is adapted to selectively advance the first band past the first slot former. A first card singulator selectively severs the sections of the first band into the respective first cards. The first band feeder may comprise a single feeder positioned between the first slot former and first card singulator. Although the first band feeder may vary in form, in a specific example the first band feeder comprises first and second elongated rolls defining a nip therebetween through which the first band passes. These rolls may include elongated lands separated by valleys with a nip being defined between the lands of the rolls. In one specific example, the rolls may be formed by machining elongated gears with the teeth of the gears forming the lands of the rolls.

As an aspect of an embodiment, a first card transporter is adapted to receive the singulated first cards from the first card singulator at a first location and to transport the singulated first cards from the first location to a delivery location. A card assembly station is provided with a first card receiving location and a second card insertion location. The card assembly station includes a card mover, such as a conveyor, adapted to move respective sets of first cards from the first card receiving location to the second card insertion location. A first card transferor is adapted to transfer first cards from the delivery location of the first card transporter to the first card receiving location. The first card transferor may comprise a plurality of pairs of rollers, with one pair of rollers being provided for each first card to be included in the set of first cards. The pairs of rollers are shifted to position each pair of rollers in engagement with a respective one of the first cards so as to transfer the set of first cards as a complete set from the first card transporter to the first card receiving location of the card assembly station.

A second card stock supplier may be included in this embodiment. The second card stock supplier is adapted to provide an elongated second band of second card stock forming material from a second roll of such material. The second card stock supplier may include a second card stock advancer which is adapted to advance the band of second card stock forming material from the second roll. A second slot former repetitively engages the second band and cuts at least one second card slot, and typically more such slots depending on the structure of the partition being manufactured, in successive sections of the second band. Each section of the second band corresponds to a portion of the second band from which a respective second card or crosscard is to be formed.

At last one second band feeder, which may be like the first band feeder, may be provided and adapted to selectively advance the second band past the second slot former. A second card singulator, which may be like the first card singulator, is adapted to selectively sever the sections of the second band into the respective second cards and to deliver the singulated second cards to the second card insertion location at which the first and second cards are combined to form the partition.

A programmed computer controller of the embodiment is coupled to the first card stock supplier and is operable to control the first card advancer, coupled to the first slot former and operable to control the first slot former to cut the first card slots, coupled to the at least one first band feeder and operable to control the advancing of the first band past the first slot former, coupled to the first card singulator and operable to control the first card singulator to control the severing of the sections of the first band into the respective first cards, coupled to the first card transporter and operable to control the first card transporter to control the transportation of the singulated first cards from the first location to the delivery location, coupled to the first card transferor to control the delivery of sets of first cards, which may be delivered individually or more preferably as an entire set, from the delivery location to the first card receiving location, coupled to the card mover and operable to control the moving of the sets of first cards from the first card receiving location to the second card insertion location, coupled to the second card stock supplier and operable to control the second card advancer, coupled to the second slot former and operable to control the second slot former to cut the second card slots, coupled to the at least one second band feeder and operable to control the advancing of the second band past the second slot former, coupled to the second card singulator and operable to control the severing of the sections of the second band into the respective second cards and to control the delivery of singulated second cards to the second card insertion location, whereby the computer controller is operable to control the production of completed partitions.

The operation of the apparatus may be automatic to provide first and second cards of the desired height and with the desired number of slots and which are assembled together into the assembled partitions. Semiautomatic operation, although less desirable, may also be employed by the apparatus with an operator being required to perform certain steps during partition formation. The conveyor may include adjustment mechanisms which are manually adjusted to provide desired spacing between sets of first cards and also desired spacing between individual cards of a set. In addition, the apparatus may be operated in a "jog" mode with individual components of the apparatus being indexed or advanced one step at a time until the apparatus is in a desired condition to commence automatic operation.

Individual parameters may be keyed in or otherwise entered into the controller from a data entry device to establish the conditions of operation of the apparatus for particular partition structures. Alternatively, a lookup table approach may also be used. That is, because partition structures tend to repeat themselves in terms of dimensions and numbers of first and second cards, the settings for the various components of the apparatus may be established for a given partition structure. Consequently, in this case an operator need only specify the type of partition being manufactured with the program controller determining from the type of partition and a lookup table the appropriate apparatus settings for manufacturing the specific partition structure.

As a further aspect of an embodiment, one or both of the first and second card stock suppliers, and typically both of these suppliers, may include a roll carrier adapted to rotatively carry a respective roll of the card stock forming material; a card forming material advancer adapted to rotate the roll to deliver the band from the roll; first and second band supports, such as rollers, each adapted to support the band with the band being delivered from the second support toward a slot former; the card forming advancer rotating the roll at a variable rate to provide a festoon of card forming material extending downwardly between the first and second band supports; a plurality of festoon sensors each positioned at a different elevation and adapted to sense the presence of the festoon at the elevation of the sensor, each sensor providing a sensor output signal indicating the sensing of the festoon by the sensor; and wherein the controller is responsive to the sensor output signals and adapted to control the card forming material advancer to control the rate of delivery of the band in response to the sensor output signals. In a specific form, at least three of such sensors are provided with the first sensor being of a first elevation, the second sensor being of a second elevation below the first elevation, and the third sensor being at a third elevation below the second elevation. In this case, detection of a festoon by the third sensor indicates the festoon which is larger than a festoon which is detected by either of the first and second sensors and not by the third sensor. In addition, in this case the detection of the festoon by the second sensor indicates a festoon which is larger than a festoon which is detected by the first sensor and not by the second sensor. Moreover, in this exemplary approach, the controller is operable to control the card forming material advancer to control the rate of delivery of the band of card forming material at a first rate in the event the festoon is detected by the second sensor and not by the third sensor, at a second rate which is greater than the first rate in the event the festoon is detected by the first sensor and not by the second sensor, and at a third rate which is less than the first rate in the event the festoon is detected by the third sensor. In a specific approach, the second rate may be about two times the first rate and the third rate about one half the first rate. A fourth sensor may also be included and positioned below the third sensor. The controller may be operable to interrupt the delivery of the band of material in the event a signal from the fourth sensor indicates the festoon is detected by the fourth sensor.

The card forming material advancer may include first and second material feed rolls which form a nip therebetween with a band of material passing through the nip and wherein at least one of the material feed rolls is rotatable by a motor to pull the elongated band from the roll to thereby rotate the roll as the respective band of card forming material is pulled from the roll. A computer controlled motor, such as a variable frequency motor, may be used to drive the rotation of the material feed rolls. The controller may be coupled to the sensors for receiving the sensor output signals and to the motor for controlling the operation of the motor in response to the sensor output signals.

One or both of the first and second card singulators may include a knife and knife actuator. The knife actuator may be adapted to selectively move the knife into engagement with the band of material to sever the sections into the individual cards. The controller may be coupled to the knife actuator and programmed to control the knife actuator and thereby the knife to control the severing of the band of material into an individual card. The operation of the knife may be coordinated with the operation of the card material feeder by the controller. In addition, the first card transporter may have a plurality of card holders which receive and transport the singulated first cards from the first location to the delivery location. In one specific approach, the controller may be programmed to cause the first material feeder to advance a respective section of the first band through the first slot former and into a respective card holder prior to severing of the section from the first band of material into the individual first card. In addition, a first card detector may be positioned to detect the presence of the respective sections of the first band of material in the respective card holders. The first card detector may provide a card presence signal indicating the presence of a section of the first band of material in a card holder. The controller may be adapted to receive the card presence signals and to interrupt the operation of the apparatus in the event a card presence signal is not received prior to the time the knife actuator is actuated to sever a card from the first band of material.

The knife actuator may have first and second spaced apart knife supporting arms coupled to the associated knife. The knife supporting arms may be supported for reciprocation in position such that the knife severs one of the sections into a card as the associated knife supporting arms reciprocate. Each knife actuator may include an eccentric coupled to the knife supporting arms so as to reciprocate the knife supporting arms upon rotation of the eccentric. A clutch brake controlled by the controller may be used to selectively couple the motor to the eccentric to drive the eccentric and reciprocate the knife supporting arms in this specific embodiment.

In one embodiment, the first card transporter comprises first and second spaced apart rotatable card holder support wheels each having a periphery. The wheels are driven in rotation by a transporter drive. The transporter drive may include a transporter drive shaft, a transporter drive motor, a first endless transporter drive loop coupled to the transporter drive shaft and to the first wheel and a second endless transporter drive loop coupled to the transporter drive shaft and to the second wheel. The card holders carried by the first card transporter may each comprise a set of first and second card supports, such as elongated tubes with card gripping elements mounted thereto, with the card supports being positioned to extend at least in part between the first and second drive loops. A plurality of sets of first and second card supports, each of the first and second card supports defining a card receiving opening therebetween, are coupled to the first and second drive loops at spaced locations along the drive loops. The controller selectively couples the transporter drive motor to the transporter drive shaft to advance the first and second drive transporter loops to position the card receiving opening of a card holder in the card receiving position. In addition, the controller selectively couples the transporter drive motor to the transporter drive shaft to advance the card containing holders to the card transfer location. In one specific construction, each first and second card support is positioned on the first and second wheels such that a majority of each card when positioned in the card holder is located inwardly of the periphery of the card holder support wheels.

The apparatus may include a first card transfer sensor positioned to sense the presence of a card in the first card transporter that should have been transferred by the card transferor. The card transfer sensor may produce a card transfer error output signal upon detection of a first card that should have been transferred. The controller may interrupt the operation of the apparatus in response to the card transfer error output signal.

The card mover in one embodiment may comprise a conveyor for moving a set of first cards from the first card receiving location to the second card insertion location at which second cards are inserted into the set of first cards. The conveyor may comprise an elongated conveyor frame having a longitudinal or lengthwise axis. First and second spaced apart endless drive chain loops may extend lengthwise along the frame with each drive chain loop being comprised of a plurality of interconnected chain links. The links may include insert receiving openings. At least one of the drive chain loops is moveable in a transverse direction relative to the longitudinal axis of the conveyor so as to permit the spreading apart of the drive chain loops. A plurality of spaced apart partition movers may extend transversely at least partially between the first and second drive chain loops. The partition movers in one example each have first and second end portions. Respective first and second chain couplers are provided at the respective first and second end portions of each such partition mover. The first and second chain couplers each include at least one coupling insert sized for insertion into respective insert receiving openings of the first and second drive chain loops to releaseably couple the partition movers to the first and second drive chain loops. A chain driver is coupled to the first and second drive chain loops and adapted to move the drive chain loops, and thereby the coupled partition movers and sets of first cards engaged by the partition movers, along the conveyor with the partition movers being movable from the first card receiving location to the second card insertion location. With this construction the spacing between the partition movers along the drive chain loops is adjustable by spreading apart the chains, detaching the partition movers to be shifted and recoupling the partition movers to the chains at the desired spacing. In this manner first cards of varying lengths may readily be accommodated. That is, for longer first cards the partition movers may be spaced further apart than the spacing used for shorter first cards.

The conveyor may also include an elongated guide with upper and lower guide portions which receive and support each set of first cards in an upright orientation as partition card movers shift the respective sets of first cards along the conveyor. The elongated guide may define a plurality of lengthwise extending guide slots. The guide slots at the first card receiving location may be of a first transverse spacing to establish a first transverse spacing between a set of first cards. In addition, the guide slots at the second card insertion location may be of a second transverse spacing. The second transverse spacing may be the same as, or may differ from, the first transverse spacing. The guide may also include a transition section between the first card receiving location and the second card insertion location. The transverse spacing between the guide slots in the transition section may be adjustable to transition the spacing along the transition section from the first transverse spacing at the first card receiving location to the second transverse spacing at the second card insertion location in the event the first transverse spacing differs from the second transverse spacing. The transition section may comprise plural elongated individual transition sections each defining a single card guide slot with the transition sections begin bendable to adjust the transverse spacing between the guide slots. At least one jack screw or other adjustment mechanism may be coupled to the transition sections and used to bend the transition sections to adjust the transverse spacing between the card guide slots.

The apparatus may include one or more sensors positioned to sense the operation of the apparatus and to indicate a potential jam or fault condition to the controller. The controller may be responsive to these sensors for interrupting the operation of the apparatus in response to the sensed signals. These sensors may include one or more of the following: a first sensor positioned to sense the insertion of first cards into the first card transporter at the first location and for producing a first sensor output signal indicating the presence of the first card received by the first card transporter at the first location; a second sensor positioned to sense the delivery of first cards by the first card transferor from the delivery location to the first card receiving location and for producing a second sensor output signal upon detection of a failure to deliver a first card from the delivery location to the first card receiving location; a third sensor for detecting the receipt of first cards at the first card receiving location and for producing a third sensor output signal in the event a first card transferred from the delivery location to the first card receiving location is determined not to have been fully received at the first card receiving location; and a fourth sensor positioned to detect the insertion of a second card into the set of first cards at the second card insertion location and for producing a fourth output signal indicating the failure of a second card to be inserted into the set of first cards at the second card insertion location. The controller may selectively interrupt the operation of the apparatus in response to fault or error indicatons determined from the first, second, third, and fourth output signals. The apparatus may include first and second card stock delivery motors, first and second band feeder motors, a transporter drive motor, and a card mover drive motor each with respective fault outputs indicating a fault condition. The controller may be coupled to each of the fault outputs and be responsive to fault signals at any of such outlets to selectively interrupt the operation of the apparatus upon the occurrence of a fault condition.

As another aspect of an embodiment, the first and second band feeder motors may include a respective servo motor operable in response to a control signal from the controller to cause the respective first and second band feeders to advance the first and second bands of material; the first card transporter may include a transporter drive clutch brake operable in response to a control signal from the controller to couple the first card transporter drive motor to the first card transporter to transport the singulated first cards from the first location to the delivery location; and wherein the card mover may include a card mover servo motor operable in response to a signal from the controller to couple the card mover drive motor to the card mover so as to move the respective sets of first cards from the first card receiving location to the second card insertion location. In addition, the first and second slot formers may each include a slot cutter, a slot drive motor and a clutch brake operable in response to a signal from the controller to cause the slot drive motor to operate the slot cutter to cut the respective first and second slots. In addition, the first and second card singulators may each include a singulator motor, a clutch brake and a knife coupled to the motor by the clutch brake. The clutch brake of each singulator may be operable in response to a respective signal from the controller to couple the singulator drive motor to the knife to cause the severing of the band of material into an individual card.

The detailed description and drawings set forth additional details of embodiments of a partition manufacturing machine in accordance with the present invention as well as of components of such an apparatus. The present invention is directed toward new and unobvious aspects of a partition manufacturing apparatus and of components thereof individually as well as in combination with one another, as set forth in the claims below.

BRIEF DESCRIPTION OF THE DRAWINGS

FIG. 4 illustrates an example of a lookup table which may be used in a computer program for the controller of FIG. 2.

FIG. 5 schematically illustrates a form of card stock supplier which may be utilized to deliver a band of card stock forming material for use in producing first and/or second cards of a partition.

FIG. 6 schematically illustrates one form of an alignment guide for guiding the delivery of the band of material from the card stock supplier of FIG. 5.

DETAILED DESCRIPTION

Figure 1:
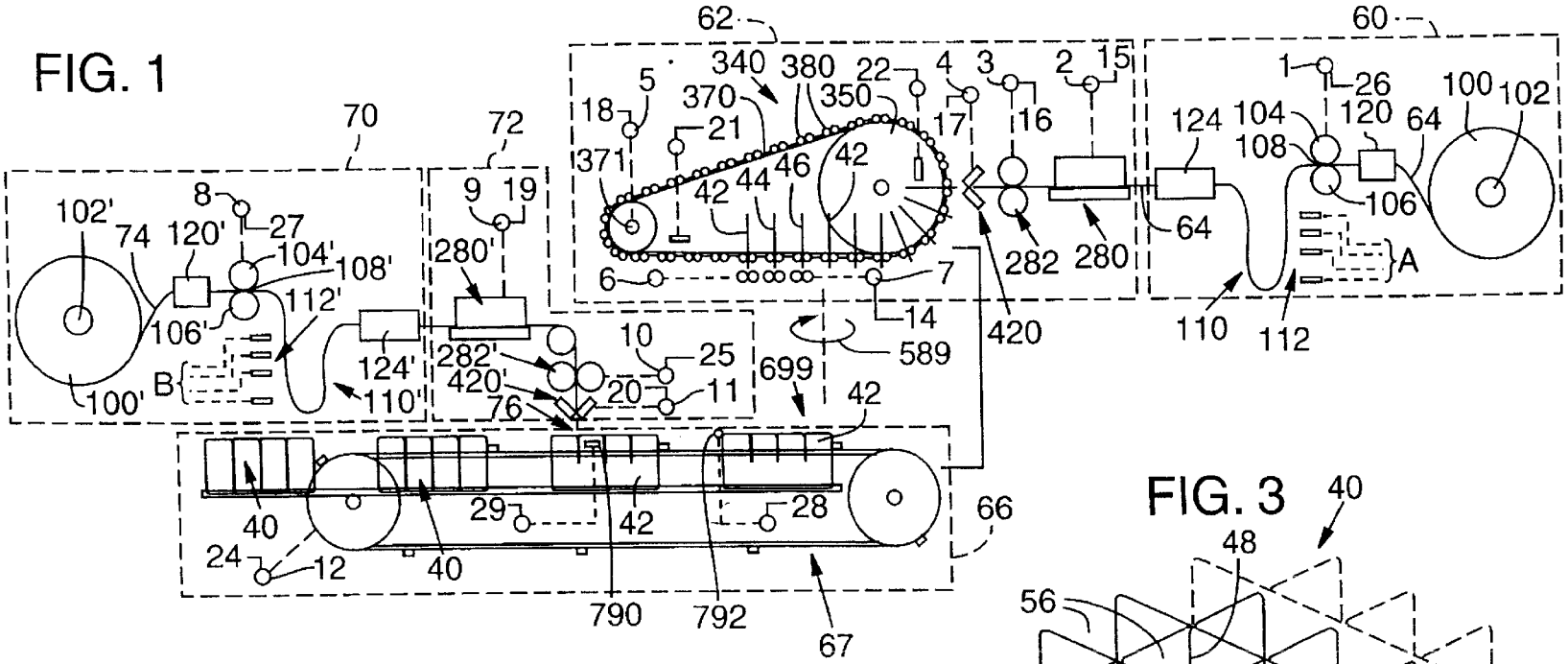
FIG. 1 is a schematic illustration of a single pass partition manufacturing apparatus in accordance with one embodiment of the present invention.
Figure 3:
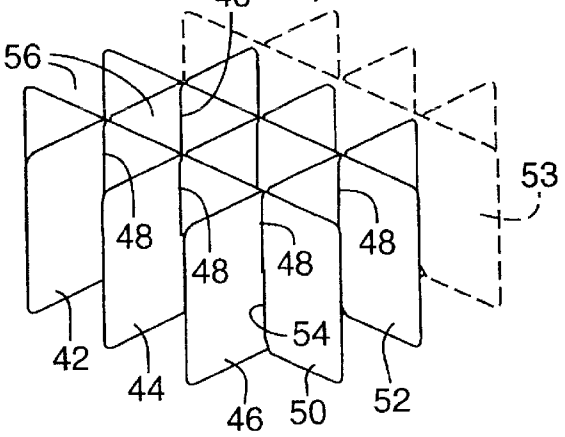
FIG. 3 illustrates one form of assembled partition which may be made by the apparatus of FIG. 1.
Figure 2:
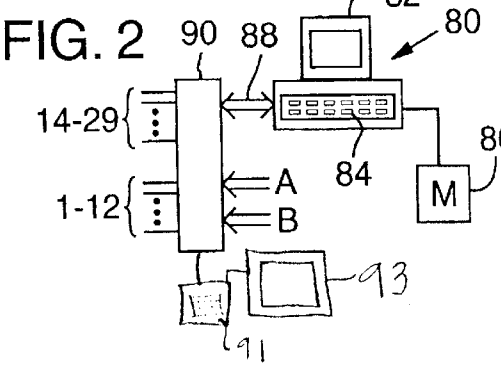
FIG. 2 is a schematic illustration of one form of a programmed controller useful in the embodiment of FIG. 1.

With reference to FIGS. 1–3, one form of an apparatus for making partitions is illustrated. FIG. 3 shows an exemplary partition 40 assembled by the apparatus of FIG. 1. The illustrated partition 40 includes a set of first cards extending in a first direction with the set of first cards including at least one such first card. In the FIG. 3 form of partition, the set of first cards includes three of such cards indicated at 42, 44 and 46. The first cards include at least one upwardly extending slot for each of the crosscards to be included in the partition. A number of these slots are indicated at 48 in FIG. 3. The slots 48 extend upwardly in a conventional manner from approximately the midpoint of the respective cards 42, 44, 46 and to the upper edge of these cards. The illustrated partition 40 also includes a set of second or crosscards with at least one such crosscard being included in the set. In the illustrated partition of FIG. 3, the set of second cards includes two such crosscards 50, 52 (with a third such card 53 being indicated in dashed lines in this figure). The second cards include one or more downwardly extending slots with one such slot being provided to interfit with each of the respective first cards. The downwardly extending slots extend from about a midpoint of the second cards to the lower edge of the second cards with one such slot being indicated at 54 in FIG. 3. The partition 40 may be collapsed by folding it flat with first cards 42, 44, 46 being positioned to extend in the same direction as second cards 50, 52, 53. When unfolded, as shown in FIG. 3, the partition cards define respective cells, some of which are indicated at 56 in FIG. 3, within which beverage containers or other objects may be placed. The partition 40 is typically inserted into the interior of a box, case, or other container. As shown by the dashed lines in FIG. 3, additional cards may be included in the partition and the length of the cards may be varied. As a specific example, the apparatus of FIG. 1 may be designed to include from one to three first cards in each set of first cards and one to five second cards in each set of second cards. This may be varied if desired.

The respective cards 42–46 and 50–52 are typically each formed from a respective band of card forming material by the apparatus of FIG. 1 as described below. The card stock forming material is typically a heavy card stock that is provided in roll form and is of a width which is of the desired length of the respective cards. An optional trimmer may be used to sever the material to the desired width as it is unrolled.

With reference to FIG. 1, the illustrated apparatus includes a first card stock supplying module or supplier indicated at 60 and a first card forming module indicated at 62. A band of first card forming material 64 passes from module 60 to the first card forming module 62. In module 62, the band of material 64 is slotted and singulated into individual cards. The sets of first cards from the first card forming module 62 are typically transferred as a set, one set at a time, from module 62 to a card assembly module 66. The card assembly module includes a card mover such as a conveyor 67 which advances the sets of first cards lengthwise along the module 66 from the location at which the cards are received from module 62. The apparatus of FIG. 1 also includes a second card stock supplying module or supplier 70 and a crosscard or second card forming module 72. A band of second card forming material 74 travels from supply module 70 to the second crosscard forming module 72. In module 72 the band 74 is slotted and separated into individual second cards. The individual second cards are inserted into slots of the first set of cards at a second card insertion location 76. The assembled partitions 40, downstream from the second card insertion location, may be delivered to a conventional partition bundler (not shown) for collapsing and bundling prior to subsequent shipment to a customer.

The apparatus of FIG. 1 may be controlled by a computer or other programmed controller such as shown in FIG. 2 and indicated generally at 80. The illustrated computer includes a monitor 82 and a data entry device such as a keyboard 84, although other forms of data entry devices may be used. In a conventional manner, computer 80 includes memory 86. Computer 80 is programmed to control the operation of the apparatus of FIG. 1. Although a programmable control apparatus is advantageous, a hardwired control system may also be used. Data and control signals to and from the apparatus of FIG. 1 pass along a data bus 88. A programmable logic controller, such as a Model A1FJ HC PU-58 controller from Mitsubishi Electric Automation, Inc. (Mitsubishi) having a place of business in Vernon Hills, Ill., is utilized in this embodiment to provide signals at the appropriate level for computer 80 and for control responsive components included in the FIG. 1 apparatus. Control signal paths are indicated at 1–12 and 14–29 and also by A and B in FIG. 2. Corresponding control locations are indicated by corresponding numbers in FIG. 1. Controller 90 may include a key pad or other data entry device 91 and a display such as a monitor 93. The programming of the computer 80 and controller 90 to control the apparatus of FIG. 1 will become apparent from the description below.

First and Second Card Stock Supply Modules

Embodiments of first and second card stock supply modules 60, 70 of the apparatus embodiment of FIG. 1 will next be described with reference to both FIGS. 1 and 5.

The first card stock supply module 60 includes a roll of first card stock forming material 100 supported by a pivot 102 for rotation. The band of material 64 is obtained from roll 100 by pivoting the roll. A first card stock material advancer is used to deliver the band of material from the roll. In one form, the first card advancer comprises first and second feed rolls 104, 106 which define a nip 108 therebetween. At least one of the rollers 104, 106 is rotated, for example by a drive motor 1. Drive motor 1 may be a variable speed motor and more specifically may be a variable frequency drive motor powered by an AC variable frequency drive controller such as a SC-A2400USUL model controller from Mitsubishi. Control signals having a frequency for the desired drive motor speed may be sent via control line 26 in response to control signals from the computer 80 to control the speed of operation of the drive motor 1 and thus the rate at which the band 64 is advanced from the roll 100. The band 64 may be delivered by the material advancer in the form of a hanging loop or festoon 110. A plurality of festoon sensors such as photocells 112 sense the position of the festoon. Output signals from these sensors are indicated at A in FIG. 1, and are delivered to computer 80. The output signals provide an indication of the size of the festoon depending upon which of the sensors 112 is/are sensing the presence of the material band 64. In response to the sensor output signals, the computer 80 causes the sending of the desired control signals via control line 26 to control the speed of motor 1 and thus the rate at which the band 64 is advanced from roll 100. Since module 60 and 70 may be the same, the operation of module 60 will become apparent with reference to the description of module 70 and FIG. 5 below. Band 64 (FIG. 1) may pass through an optional decurler 120 which, in a conventional manner, may be used to remove the natural curl that would exist in band 64 as a result of the band being wound on the roll 100. In addition, the band 64 may pass through an alignment guide 124 for alignment purposes prior to delivery to the first card forming module 62.

Although each of the first and second card stock supply modules may be different from one another, preferably they are of the same construction. Rather than describe the elements of module 70 in detail, elements of module 70 in FIGS. 1 and 5 corresponding to those of module 60 are indicated by the same number with a "prime" designation. In module 70, a motor 8, which may be a variable frequency drive motor powered by an AC variable frequency drive controller like motor 1 of module 60, drives at least one of the rolls 104' 106' to advance the band of material 74 from the roll 100' in response to control signals along control line 27 under the control of the computer 80.

Referring to FIG. 5, the second card stock supplier module 70 includes a frame 130 which pivotally supports the roll 100'. The decurler 120' again may be of a conventional construction. For example, the decurler may include first and second rollers 132, 134 and a decurling roller 136 positioned beneath the band 74. The roller 136 is raised upwardly, for example, by adjusting a jack screw 137 support, to decurl the band. The extent of decurling may be varied by varying the position of roller 136 such as indicated by the arrows 138 in FIG. 5. Typically as the roll is reduced in diameter, more curl is present in the band 74 and a correspondingly greater decurling force is exerted against the underside of the band 74. Any suitable decurling mechanism may be used if desired.

In the illustrated embodiment of FIG. 5, the band 74 passes through the nip 108' and droops or is looped downwardly to form a festoon 110'. The roller 106' thus supports one side of the festoon. The other side of the festoon is supported by a roller 150. The band 74 is advanced in an intermittent fashion downstream from the roller 150 as individual second cards are severed from the band and a next section of the band is advanced into position for severing of a subsequent second card. The motor 8 feeds the band 74 to the festoon at a rate which is variable to maintain the festoon at a desired size.

In the illustrated embodiment, the sensors 112' comprise a first sensor 160 supported, such as by frame 130, a second sensor 162 positioned below sensor 160 and also supported by the frame, and a third sensor 164 positioned below the second sensor 162. The sensors 112' may also include a fourth sensor 166 positioned on the frame 130 below the sensor 164. The size of the festoon is determined by sensor output signals which are provided by the respective sensors 160–166 when they detect the presence of a portion of the festoon adjacent to the sensor. With this arrangement, detection of a festoon by sensor 166 indicates a festoon which is larger in size than a festoon detected by sensors 160–164. Similarly, a festoon detected by sensors 160 and 162 but not by sensors 164 and 166 indicates a festoon which is smaller in size than one detected by the lower sensors. Likewise, a festoon detected only by sensor 160 is indicated to be smaller in size than a festoon detected by sensor 160 and any of the other sensors.

The computer 80 causes a control signal to be sent via control line 27 to control motor 8 and thereby controls the rate at which the band 74 is advanced depending upon the sensed size of the festoon. As one specific example, the computer controller is operable to control the motor 8 and thus the advancing of band 64 at a first rate in the event the festoon is detected by sensor 162 and not by sensor 164, at a second rate which is greater than the first rate in the event the festoon is detected by the sensor 160 and not by the sensor 162, and at a third rate which is less than the first rate in the event the festoon is detected by the sensor 164. With this variable speed control, the festoon generally oscillates at locations between sensor 160 and 164 during normal operation of the apparatus. In this specific form, the sensor 166 in effect is a fail-safe sensor. If the festoon droops to the position where it is detected by sensor 166, the controller may operate to cause an interruption of the delivery of the festoon 74 and may cause the apparatus to shut down under these conditions. The positioning of festoon 110' at the level of sensor 166 would not normally happen unless a jam has occurred downstream from the festoon. Also, if the festoon is not detected by any of the sensors 160–164, the controller may be programmed to shut down the apparatus.

In a specifically preferred example, the second rate is about two times the first rate and the third rate is about one-half the first rate. Consequently, instead of simply on/off operation of the band advancer, a variable speed approach is used in this illustrated embodiment. As a specific example, the first speed may be 1500 in/min., the second speed may be 3000 in./min. and the third speed may be 750 in./min.

Figure 6A:
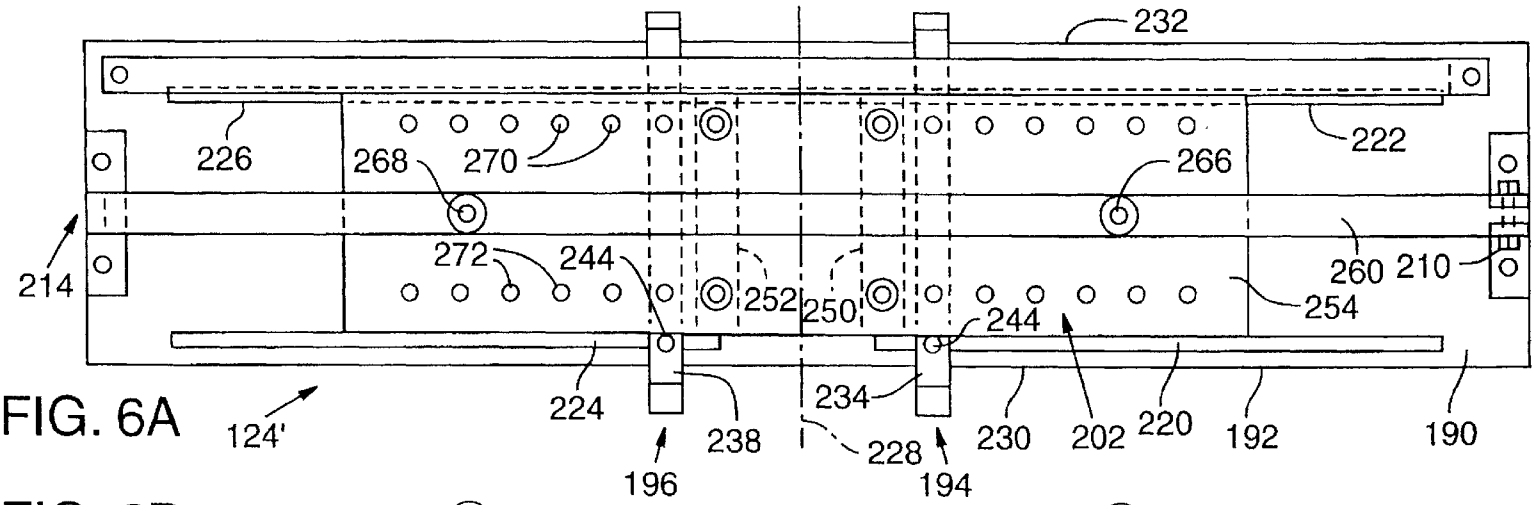
FIG. 6A is a top view of a specific form of alignment guide of the type shown schematically in FIG. 6.
Figure 6B:
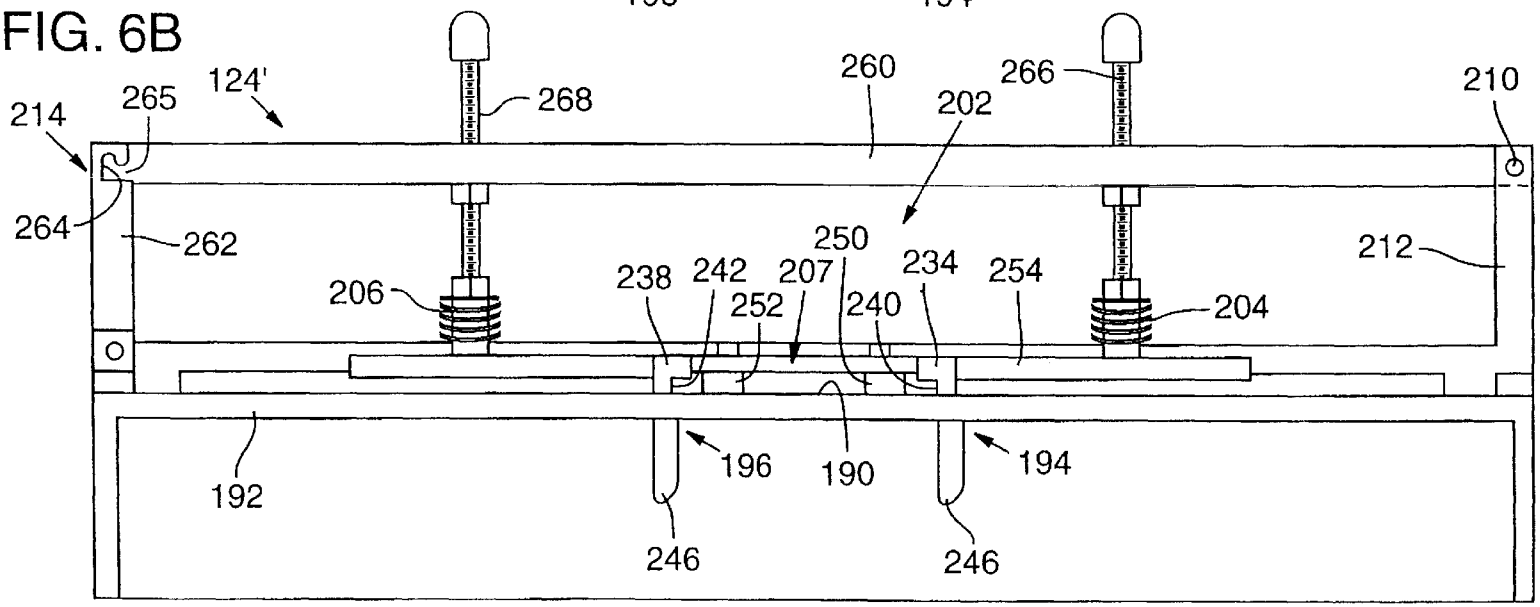
FIG. 6B is a front view of the alignment guide of FIG. 6A.

The alignment mechanisms 124, 124' in the modules 60, 70 may take any convenient form and may take the form of the mechanism 124' shown in FIGS. 6, 6A, and 6B.

As illustrated schematically in FIG. 6, the band of material 74 is supported on the upper surface 190 of a table 192. The side edges of band 74 are positioned between side edge guides 194, 196. The side edge guides 194, 196 are adjustable inwardly and outwardly, as indicated by respective arrows 198, 200 to accommodate bands 74 of different widths. A pressure applicator 202 applies a downward force to the upper surface of the band 74. For example, tensioning springs 204, 206 which apply a biasing force to a structure 207 which applies a force to the upper surface of the band 74 may be used for this purpose. As indicated by arrow 208, the pressure applied to the tensioning springs and thus on structure 207 and to the upper surface of band 74 may be varied. In the illustrated construction, the structure 207 is pivoted at 210 to a frame element 212 projecting upwardly from the table 192. A latch 214 releasably holds the structure 207 in place. Alignment guide 124' aligns the band 74 of card stock forming material with the second card forming module 72. Similarly, the guide 124 of module 60 aligns the band 64 with the first card forming module 62 (FIG. 1).

A more specific example of a suitable band material alignment guide is shown in FIGS. 6A and 6B. In the illustrated embodiment, the table 192 includes four elongated slots 220, 222, 224, and 226 extending lengthwise along the table in a direction which is perpendicular to the transverse centerline 228 of the table. Slots 220, 224 are each located adjacent to a first edge 230 of the table while the slots 222, 226 are located adjacent to a second edge 232 of the table. The inwardmost ends of the respective slots, that is the ends closest to the centerline 228, are spaced from one another and spaced from the centerline 228. The illustrated guides 194, 196 include respective transversely extending guide bars 234, 238 which are undercut or notched respectively at 240, 242. The respective side edges of band 74 are positioned in respective notches 240, 242 during normal operation of the alignment guide. When guide bars 234, 238 are slid to their desired positions, they are detachably secured in place. For example, fasteners such as bolts, two of which are indicated at 244 in FIG. 6A, may be each inserted through a respective one of the slots 220–226 and into a respective clamping element 246 at the underside of the table 192. The bolts may be tightened into clamping elements 246 to clamp the guides 234, 238 in place. Thus, the respective ends of the guide bars 234, 238 are clamped to the table. Pressure applying elements such as bars 250, 252 may be bolted or otherwise secured to a support plate 254 to form an embodiment of structure 207. The undersurface of bars 250, 252 bear against the upper surface of the band 74 as the band is guided. Springs 204, 206 apply pressure to the upper surface of the plate 254 and hence via the bars 250, 252 to the band 74 as it passes through the alignment guide 124'. A frame cross member 260 is pivoted at 210 to the frame element 212. In this case, the latch 214 includes a link 262 with a latch receiving notch 265 provided in the upper end of the link. The cross member 260 includes a latch element 264 shaped to fit within the latch 264 to releasably latch the member 260 to the link 262 and thus to the table 192. Tension adjustment screws 266, 268 may be rotated to adjust the compression on the springs 204, 206 to thereby adjust the biasing force applied to plate 254 and hence by elements 250, 252 to the band of material. As can be seen in FIG. 6A, a plurality of spaced apart openings, some being indicated at 270 and 272 in FIG. 6A are provided along the length of plate 254 to provide various positions at which bars 250, 252 may be mounted and to accommodate additional pressure applying bars in the event wider card stock forming band material is used.

First Card Forming Module

The first card forming module 62 is best understood with reference to FIG. 1 and FIGS. 7–10.

The illustrated form of first card forming module includes a first slot former 280 for repetitively forming the slots 48 in sections of material of band 64 which are ultimately to be severed into individual first cards. The details of a suitable slot former 280 are described below in connection with FIG. 16 in connection with the slot former 280' used to form the slots 54 in the second cards as both the slot formers 280, 280' may be the same. In general, the first slot former 280 includes a die which is urged into engagement with the band 64 to cut the slots 48 in the respective first card forming sections. The die is typically replacable with dies of different configurations to cut the desired pattern of slots 48 in the first cards. The first slot former 280 may include a die actuator for repetitively causing the die to engage the band 64. In one specific form, the actuator includes a motor 2 coupled to the die for driving the die into engagement with the band 64. The motor may continuously operate and be selectively coupled to the die, for example, by a clutch brake. One suitable clutch brake is a model 30827 clutch brake from Warner Electric of Pitman, N.J. The clutch brake may be coupled to an eccentric and trip mechanism so that, in response to a control signal on line 15 from the controller 80 (FIG. 2), the clutch brake couples the motor to drive arms connected to the slot forming die to reciprocate the drive arms and die through one stroke to form the desired slots in the section of the band of material 64 positioned beneath the die. Again, the details of a suitable slot former will be more apparent from the description of FIG. 16 below.

At least one first band feeder is adapted to selectively advance the first band 64 past the first slot former 280. Although more than one band feeder may be used, in the illustrated embodiment a single band feeder 282 is employed. Band feeder 282 includes first and second rolls 284, 286 (FIG. 7) which define a nip 287 between the rolls. The band 64 passes through the nip 287. At least one and preferably both of the rolls 284, 286 are driven in rotation, for example by a motor 3 coupled to the rolls. The motor, for example, may be a Model HC-RF203K servo motor from Mitsubishi which is coupled through a 15 to 1 gear reducer to one end of a shaft which supports one of the rolls. The opposite end of this shaft may be coupled to the opposite end of the shaft containing the other roll so as to drive the rolls together. This coupling of shaft ends may be accomplished by intermeshing gears, one being mounted to each shaft. The motor 3 may operate in response to a control signal on line 16 caused by the computer 80 to drive the rolls 284, 286 and thereby to selectively advance the band 64. The rollers 284, 286 are driven to advance or index the band 64 a distance which corresponds to the height of one of the first cards. Consequently, each time rollers 284, 286 are operated, a new section of the band 64 is positioned in slot former 280 for engagement by the die and formation of the required slots.

The illustrated first card forming module 62 includes a frame 289 (FIG. 7) having horizontal frame elements such as element 288 supported by respective legs 290, 292. The frame 289 supports the slot former 280 and the other components of the first module 62. The frame 289 may include a mechanism to facilitate controlled movement of the frame. For example, the legs (e.g., legs 290, 292) of the frame may be carried by respective wheels 294, 296 which may each be in the form of a pulley having a central groove. The grooves are respectively indicated at 298, 300 in FIG. 7. The grooves 298, 300 engage respective rails 302, 304. Consequently, the entire module 62 in this example may readily be slid along rails 304, 302 in a direction which is orthogonal to the pathway of band 64 through the module 62. This facilitates alignment of the module 62 with downstream components, e.g., the card moving conveyor 67 (FIG. 1), so that sets of first cards (see for example 42, 44, and 46 in FIG. 7) may be delivered from module 62 to the first card receiving location of the downstream conveyor in a simple, straight-forward manner. When the frame 289 is positioned at the desired location along the rails 302, 304, a clamp, brake or stop, not shown, may be used to hold the frame on the rails at the desired location.

An adjustable biasing mechanism, such as indicated at 319 (FIG. 7), may be used to establish the force at which rollers 284, 286 engage one another at the nip 287. For example, biasing mechanism 310 may include a shaft 312 mounted to the frame 289 with one such shaft being positioned adjacent to each end of the respective rollers 284, 286. The roller 286 may be slidably mounted to the shaft 312 with a spring 314 held onto the shaft 312 by a fastener, such as a nut 316, being used to apply a biasing force to urge roller 286 against the roller 284. Fastener 316 may be tightened or loosened to adjust the biasing force.

The feed rollers 284, 286 may each comprise elongated spur gears keyed or otherwise mounted to a respective drive shaft. The gears are machined to provide flat gripping surfaces or lands for the band 64. These gripping surfaces or lands comprise the flattened portions of the gear tips with some of these lands being indicated at 320, 322 in FIG. 7. As a specific example, the rollers 284, 286 may each comprise a 36-tooth spur gear such as a Boston YH36C spur gear from Boston Gear Company of Quincy, Massachusetts. These spur gears may be machined to a desired diameter such as from 4.490 to 4.492 inch ±0.01. In addition, the card stock engaging surfaces of the lands may be provided with a 250 finish with the gears being hardened to RC45 after machining. The rollers 284, 286 are advanced with the lands 320 of roller 284 opposed to the lands 322 of roller 286 at the nip 287 so that respective lands 320, 322 engage one another and define the nip 287 therebetween. Although other mechanisms may be used for advancing the band 64, this specific feed mechanism precisely advances the band 64 and facilitates the formation of uniform first cards.

Figure 7:
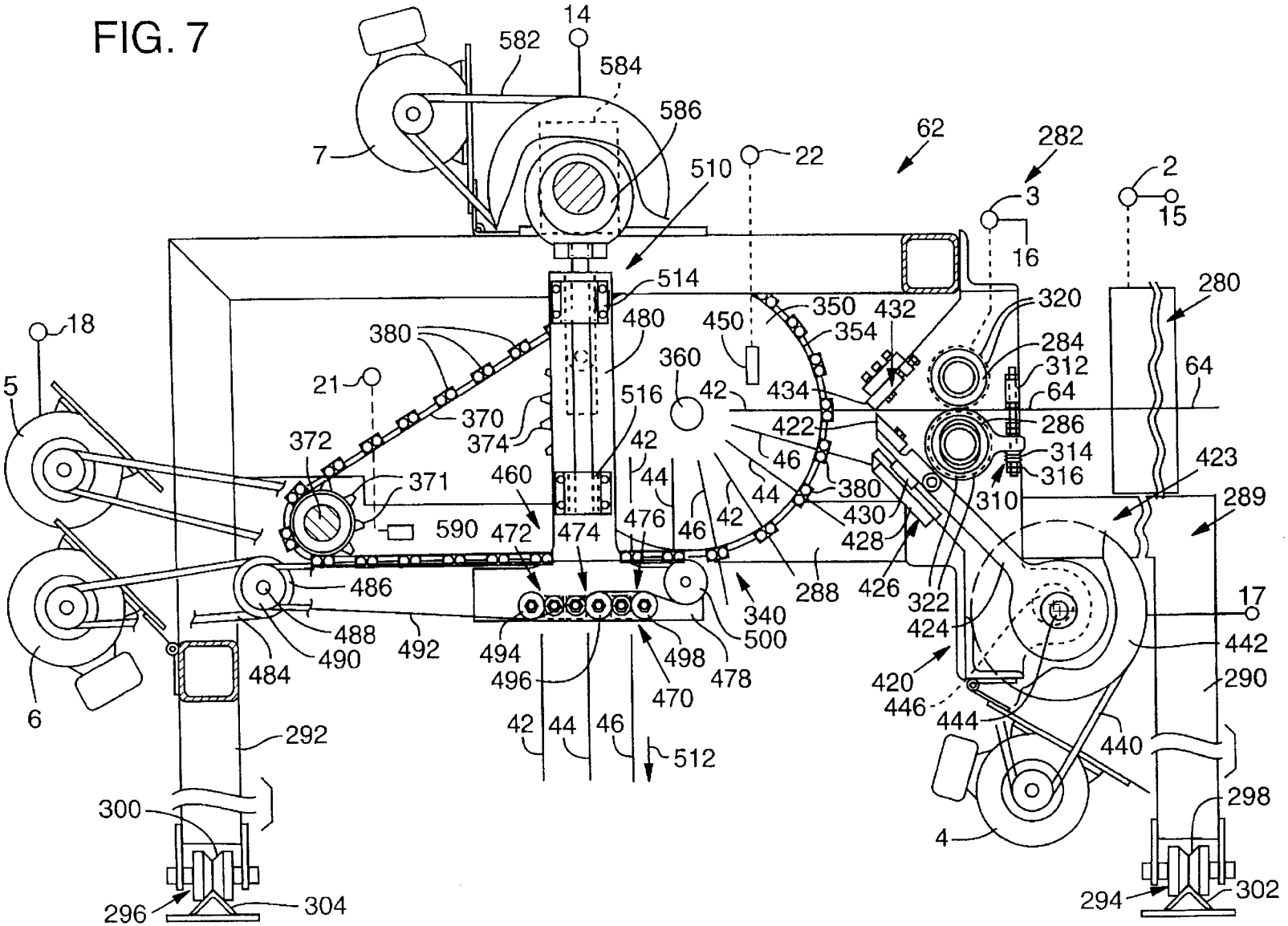
FIG. 7 is a side elevation view of one exemplary form of first card forming module for the apparatus of FIG. 1.
Figure 8:
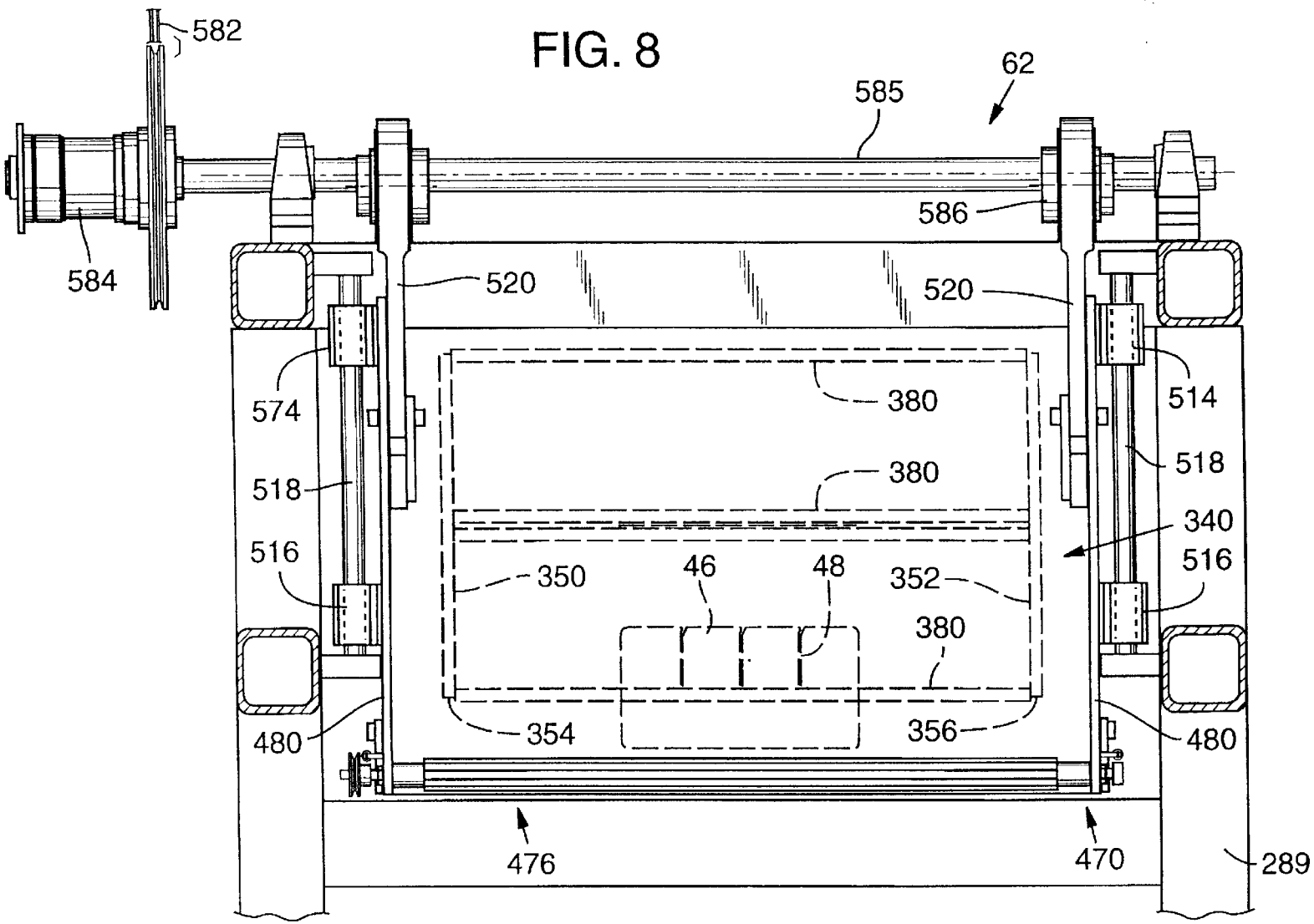
FIG. 8 is an end view of a carousel portion of the module of FIG. 7.

The illustrated module 62 also includes a first card transporter which may be of a form indicated at 340 in FIGS. 1, 7, and 8. The illustrated first card transporter includes a card transporting carousel which may include first and second upright, spaced apart wheels 350, 352 having respective outer peripheries 354, 356. The wheels are rotatably coupled to the frame 289 by a wheel supporting shaft 360. A first endless drive loop 370, such as a drive chain, is drivenly connected to a drive gear 371 on a drive shaft 372 and also to cogs 374 about the periphery of wheel 350. Consequently, rotation of shaft 372 causes a rotation of the wheel 350 and also the travel of the drive chain 370 about the periphery of wheel 350. A similar drive chain may be employed at an opposite end portion of shaft 372 for coupling to the drive wheel 352. A portion of this other drive chain is indicated at 376 in FIG. 9. A drive motor 5 (FIG. 7) is drivenly coupled to drive shaft 372 for driving the shaft and thereby the drive chains 370, 376. Motor 5 may be controlled in response to a control signal on line 18 from the computer 80 (FIG. 2). More specifically, in a preferred embodiment, the motor 5 continuously operates and is selectively coupled to drive shaft 372 by an actuator such as a clutch brake which may be of the form previously explained. In response to a control signal on line 18, the clutch brake couples motor 5 to drive shaft 372 to advance the drive shaft, and thereby the chains 370, 376, an indexed or desired amount for delivery of a next first card into the carousel.

A plurality of card receiving receptacles 380 (FIG. 7) are carried by the drive chains and are spaced apart a predetermined distance, which may be adjusted, along the drive chain. The distance between these receptacles corresponds to the distance the wheels 350, 356 are indexed in the illustrated embodiment each time the shaft 372 is driven.

Figure 9:
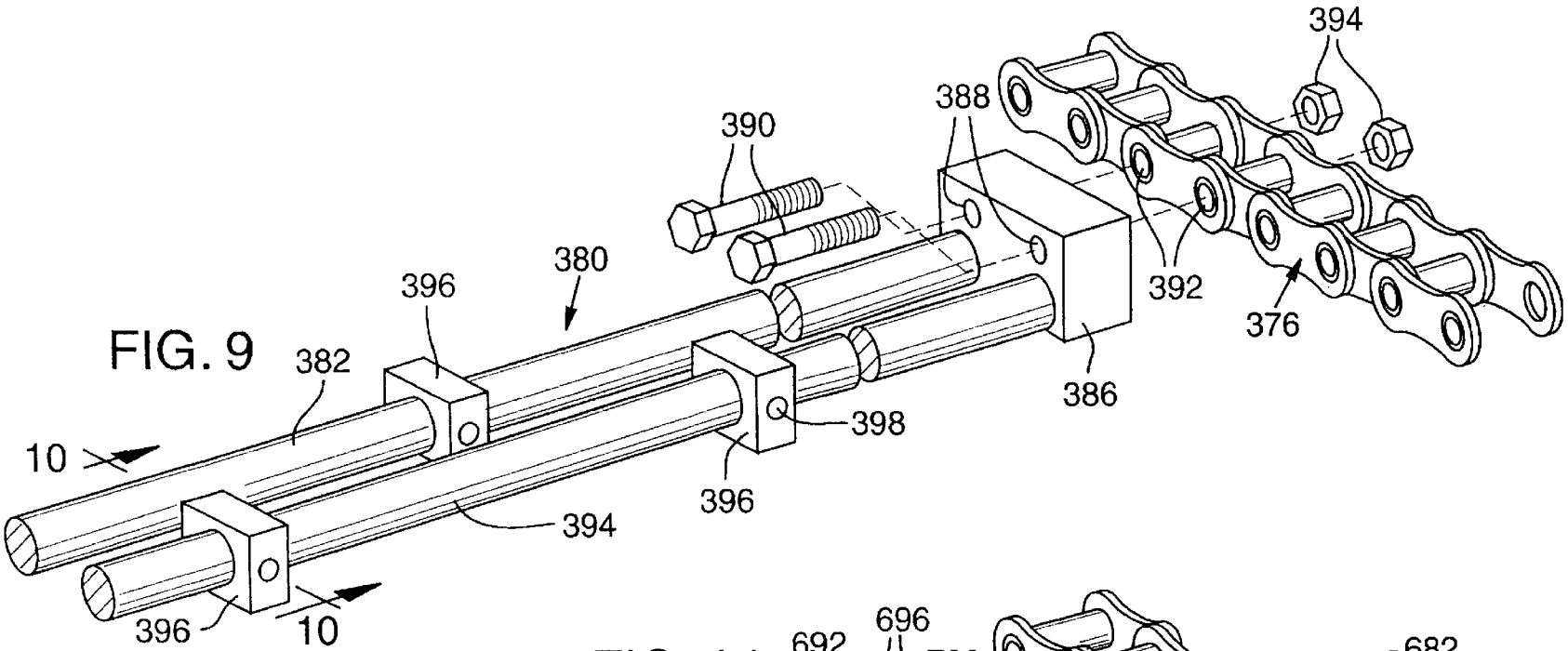
FIG. 9 is a perspective view of a portion of one embodiment form of a card receiving holder for the carousel of FIG. 8.
Figure 10:
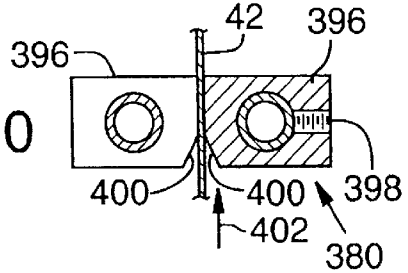
FIG. 10 illustrates the positioning of a first card between two card grippers included in the card holder of FIG. 9.

With reference to FIGS. 9 and 10, each of the card holders or receptacles 380 may comprise first and second elongated tubes 382, 384 which extend generally between the chains 370, 376. A mounting block, such as block 386 (FIG. 9), may be mounted to each of the respective ends of the tubes 382, 384. Block 386 may have fastener receiving apertures 388 through which fasteners, such as bolts 390, are inserted. The bolts 390 extend through openings 392 in the chain links forming the chain 376. For example, the chains 370, 376 may be conventonal RC40 hollow pin chains provided with openings 392. Fasteners such as nuts 394 may be used to detachably secure the mounting block 386 and thus the card holder 380 to chain 376. The opposite ends of the tubes 382, 384 may be coupled to the chain 370 in the same manner. Although adjustment of spacing of the holders 380 along the chains 370, 376 is typically not required, it is possible with this construction. That is, the fasteners 390 may be removed with the spacing between the holders 380 then being adjusted before the holders are refastened to the chain.

The tubes 382, 384 are typically somewhat resilient. As a specific example, the tubes may be of UNS 610200 Steel and may have a 0.5 inch diameter and a wall thickness of 0.031 inch. The tubes may be, for example, 29.3 inches in length. The holders 380 may include a plurality of card grippers, some being indicated at 396 in FIGS. 9 and 10. The grippers may be of any convenient shape, for example, they may be round instead of the shape shown in FIGS. 9 and 10. The grippers 396 may be slidably mounted to their respective cross-members (e.g., tubes 382, 384) to permit sliding of these grippers to desired positions along the length of the supporting tubes. The grippers on the respective tubes 382, 384 may be positioned opposite to one another or may be staggered as shown in FIG. 9. In addition, releasable fasteners, such as set screws 398, may be used to releasably secure the grippers at a desired location along the respective cross-members. As shown in FIG. 10, the leading edges 400 of the grippers 396 may be beveled so that a first card (e.g., card 42 in FIG. 10) when inserted between the grippers 396 in the direction of arrow 402 tends not to catch or hangup on the edges of the grippers. Round grippers function in this same manner. The card 42 may be bent slightly when inserted past the grippers so that the card is bent slightly when held by the grippers to thereby provide an enhanced gripping force between the holders 380 and cards.

In the embodiment of FIG. 7, the band of material 64 is advanced by feeder 282 into a holder 380 which has been indexed to a first card receiving location. Individual cards may be singulated before insertion into the respective holder. However, in the illustrated embodiment, the band 64 is inserted into the appropriately positioned holder 380 prior to singulation by a first card singulator. One form of first card singulator is indicated at 420 in FIG. 7. The illustrated singulator 420 includes a knife or knife blade 422 which spans the width of the band 64 and is actuated to repetitively engage the band 64 to cut sections of the band into the individual first cards. Feeder 282 advances the desired amount of material (e.g., corresponding to the height of the desired first card) past the knife blade and into the holder 380. An actuator 423 then reciprocates the knife blade to sever the section of the band and form the individual first card. Although the actuator may take other forms, in the illustrated example, the knife blade actuator 423 includes first and second spaced apart knife blade supporting arms 424 (one being numbered in FIG. 7) respectively positioned along opposite side edges of the band 64. The end portions of the knife blade 422 are typically bolted or otherwise detachably fastened to the distal ends of the respective actuator arms. The illustrated actuator also includes, for each arm, a slide guide 426 including a track 428 carried by the frame 289 and a track engager 430 slidably coupled to and captured by the track 428. The guide 426 confines the movement of the associated arm 424 so that it reciprocates in a first direction. An elongated backup element such as a bar 432 is detachably coupled to the frame 289 and spans the width of the band 64. The upper edge of the knife blade 422 in FIG. 7 slides along the lower edge 434 of bar 432 during a blade cutting stroke. Bar 432 thus backs up the band 64 at the location where the band is severed. The arms 424 may be reciprocated by selectively coupling a motor 4 to the arms. More specifically, as can also be seen in FIG. 16A for the singulator included in the module 72, the motor 4 may continuously drive a drive belt 440 which is coupled to a clutch brake 442, such as previously explained. In response to a control signal from computer 80 (FIG. 2) on control line 17 (FIG. 7), the clutch brake couples the motor to the drive arms 424 such that the drive arms 424 reciprocate through one complete stroke and then stop until the next control signal is delivered to the clutch brake. More specifically, when actuated, a drive shaft 444 is driven through one revolution or rotation and drives an eccentric 446 through one rotation. The eccentric is coupled to the arms 424, for example by a bearing, and moves the arms 424 through one stroke. A conventional solenoid operated trip mechanism may be used to couple the motor 4 to the shaft 444 for one revolution of the shaft. Alternative singulator drive mechanisms may be used, although the illustrated construction is advantageous.

As previously mentioned, in the illustrated embodiment the band 64 is inserted into the respective holder 380 prior to severing by the knife blade 422. In addition, in the illustrated embodiment a majority of each card (e.g., see card 42 in FIG. 7), extends inwardly of the periphery of the wheels 350, 352 when severed from the band 64. In the embodiment of FIG. 7, a sensor 450, such as a photocell, is positioned to detect the presence of a card in the holder 380 which is in the card receiving position. A signal from sensor 450 passes along control line 22 to the computer 80 with this sensor output signal indicating the presence of the first card received by the card transporter 340 in a holder 380 at this first location. In the event sensor 450 does not sense the presence of a card prior to the actuation of the singulator 420, this provides an indication that the apparatus has jammed or malfunctioned. In response, the computer 80 may cause the apparatus to shut down. Consequently, any such jams may be cleared and the system may be checked before a problem has reached a magnitude where the apparatus may be damaged or become extremely difficult to clear for subsequent operation.

The respective card receptacles 380, when filled with cards, are indexed, in a clockwise direction in FIG. 7, from the card receiving location to a card delivery location 460. Although the first cards may be delivered individually from the card transporter 340 when they reach the card delivery location, in the illustrated embodiment a complete set of first cards required for a partition are delivered at one time. Thus, in a three first card embodiment, the cards 42, 44, and 46 are simultaneously delivered from the transporter 340 at the delivery location. As can be seen in FIG. 7, the cards within the receptacles 380 include a projecting portion which extends outwardly beyond the receptacles 380. A card transferor is utilized to transfer each set of first cards from the transporter 340 to a downstream location in the partition assembly process. One specific form of card transferor is indicated generally by the number 470 in FIGS. 1, 7 and 8. The illustrated card transferor includes plural pairs of rollers, one pair being provided for each card of the set. In this case, the pairs of rollers are indicated at 472, 474 and 476. Each pair of rollers defines a nip therebetween with the rollers being driven in a direction to move cards downwardly through the nip in the FIG. 7 embodiment. The rollers are pivotally mounted at each end to a respective cross-piece portion 478 of a first card transferor actuator having an upright arm portion 480. As can be seen in FIG. 8, a first arm is positioned outside of wheel 350 and a second arm 480 is positioned outside of wheel 352. The set of rollers 476 are shown extending between the arms 480 and beneath the wheels 350, 352. A drive motor 6 (FIG. 7) is coupled by a belt 484 to a drive pulley 486 mounted to a shaft 488. As shaft 488 is rotated, a pulley 490 rotates. Pulley 490 drives a belt 492 coupled by drive pulleys 494, 496 to the pairs of rollers 472, 474 to drive these rollers in the appropriate direction. The belt 492 also is guided by a pair of idler rollers 498, 500. A similar belt at the opposite side of the first card forming module 62 is driven by a pulley mounted to the shaft 488 for rotating the last pair of rollers 476 in the desired direction.

In the illustrated form of transferor 470, the pairs of rollers 472, 474 and 476 are selectively raised upwardly to engage the cards 42, 44 and 46 to pull these cards in the direction of arrow 512 to the downstream portion of the apparatus (to the assembly module 66) and from the delivery location of the card transporter 340.

Although other actuator mechanisms may be used, in the form illustrated in FIGS. 7 and 8, each of the arms 480 includes an upper and lower guide receiving sleeve 514, 516 mounted to the exterior surface of the respective arms 480. The frame 289 supports respective guide elements such as tubes 518 (FIG. 8) which are slidably coupled to sleeves 514, 516. The sleeves may include bearings therein to facilitate this movement. Guides 518 are typically vertical and confine the motion of the arms 480 in upward and downward directions. Respective reciprocating arms 520, one being positioned at each side of the module 62, are each coupled at a lower end portion to a respective arm 480. A drive mechanism is provided for driving the actuator arms 520 in reciprocation. In the illustrated embodiment, a motor 7 (FIG. 7) continuously drives a belt 582 which is coupled to a clutch brake 584. In response to a control signal on line 14 from the computer 80 (FIG. 2), the clutch brake 584 couples the motor 7 to a drive shaft 585 (FIG. 8) which drives an eccentric 586 through a single rotation. This driving action results in the reciprocation of the arms 520, 480 and the corresponding raising and lowering of the pairs of rollers 472, 474 and 476. A conventional solenoid actuated trip mechanism, such as employed with the singulators previously described, may be used in this specific form of transferor actuator.

A sensor, such as a photosensor 590 (FIG. 7), may be mounted to frame 289 in a position to detect the presence of one of the first cards in a holder 380 at a location downstream from where the card should have been transferred by transferor 470 from the card transporter 340. If the presence of a card is sensed at such a location by sensor 590, a signal is sent via control line 21 to the computer 80 (FIG. 2). In response to such a signal, and thus to the detection of a failure to deliver a first card from the delivery location to the first card receiving location, the controller may, for example, shut down the operation of the apparatus. This minimizes the risk of a significant jam taking place in the apparatus.

FIG. 1 is a two dimensional representation of a three dimensional apparatus. The arrow 589 in FIG. 1 is included to indicate that modules 60, 62 are typically at right angles to module 66.

Second Card Forming Module

Figure 16:
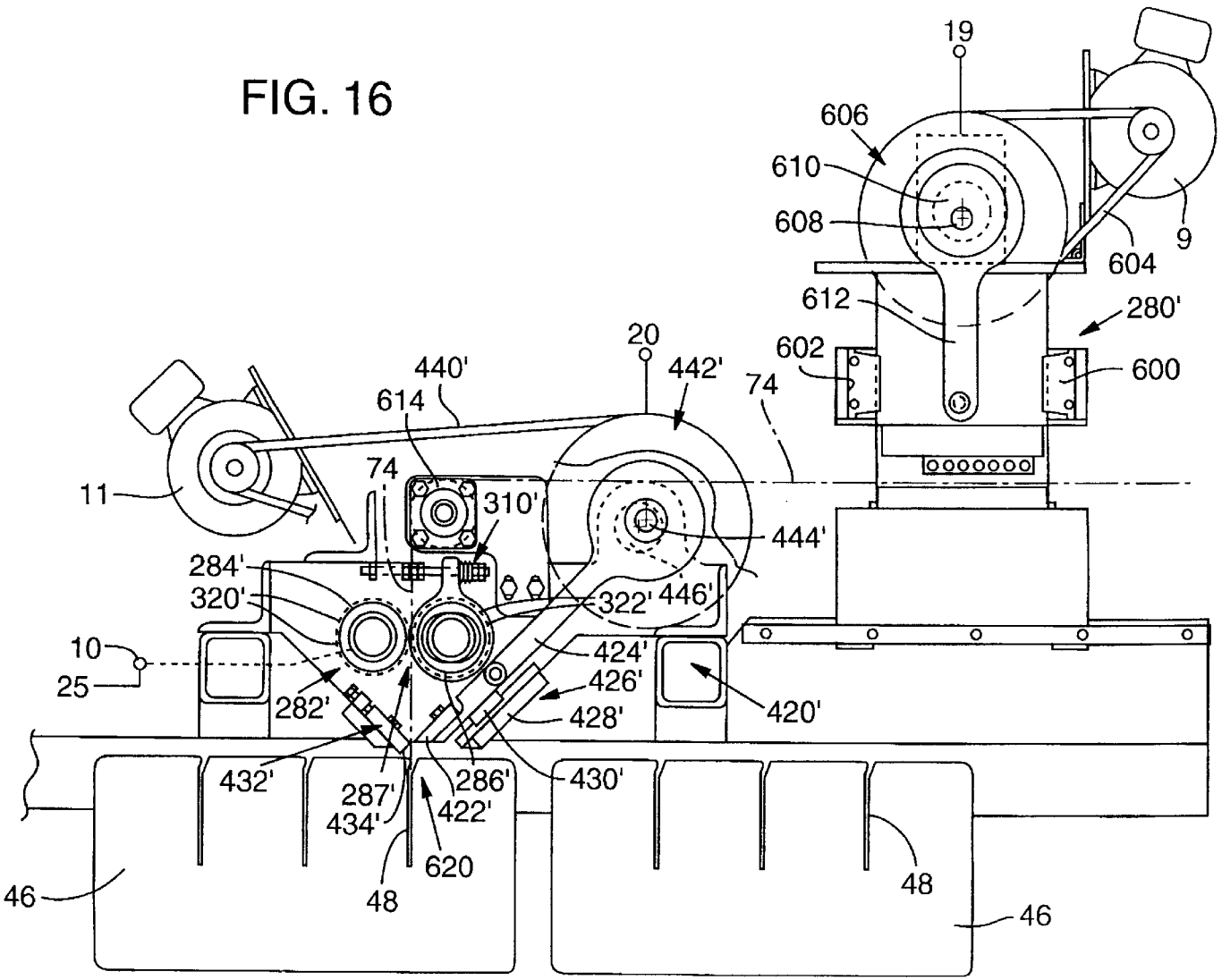
FIGS. 16 and 16A illustrate a form of second card forming module for the apparatus of FIG. 1 in greater detail.
Figure 16A:
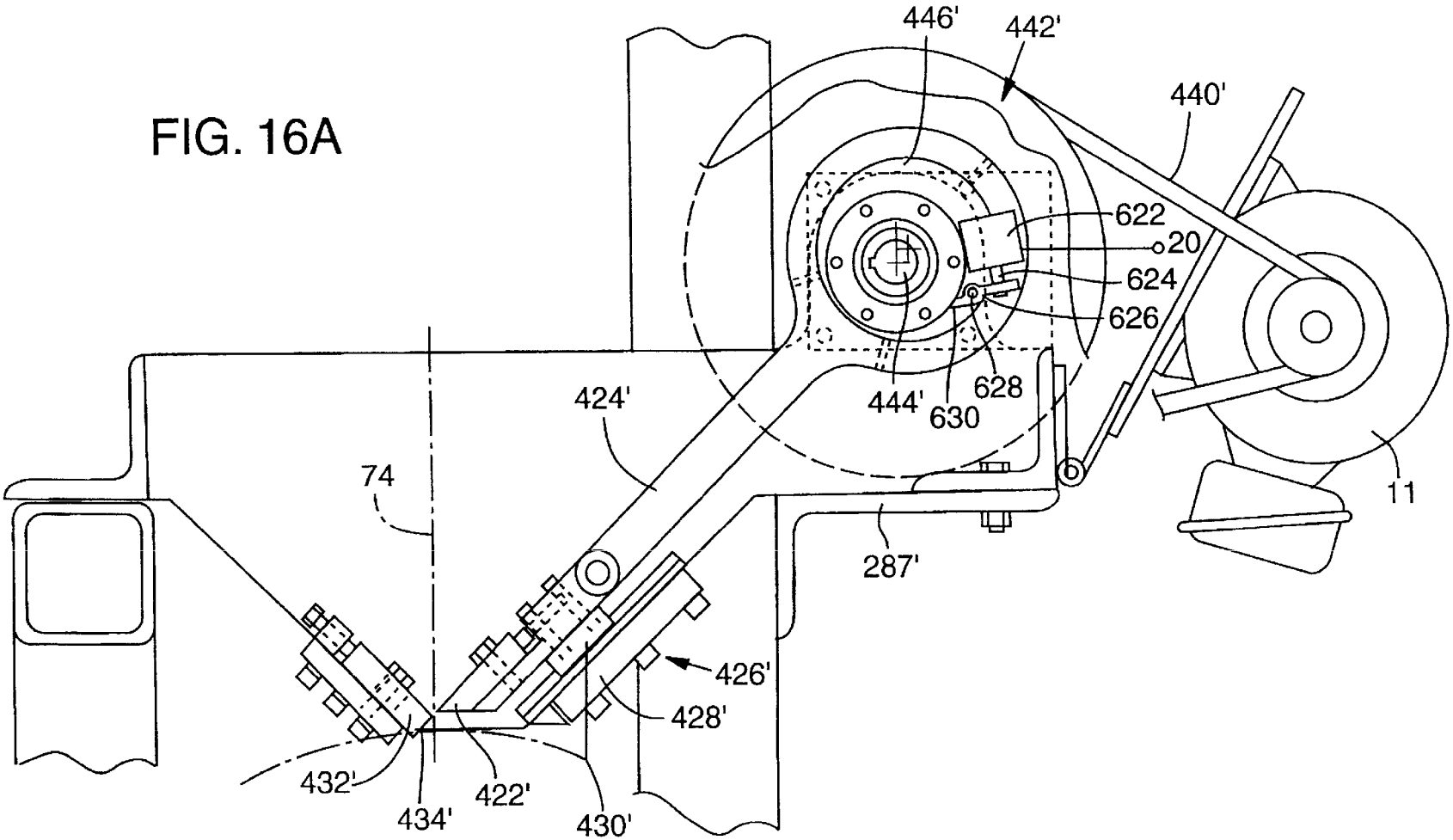

The second card forming module is best understood with reference to FIGS. 1, 16, and 16A. Since many of the elements of second module 72 may be the same as elements in module 62, for convenience, these common elements in the illustrated embodiment have been assigned the same number with a "prime" designation in FIGS. 1, 16, and 16A as the corresponding elements of module 62. These common elements will not be re-described in detail as they have been previously described above.

In general, the band 74 of second card forming material is delivered from material supplier 70 to the second slot former 280'. Slot former 280' includes a die which is configured to form the desired slots in sections of the card forming material 74 which are to form the individual second or crosscards. The die is typically reciprocated for this purpose. Guides, such as indicated generally at 600, 602 in FIG. 16 may be used to limit the motion of the die in an upward and downward direction. An actuator is provided for reciprocating the die to form the slot or slots in the second cards. The actuator may include a motor 9 which continuously drives a drive belt 604 coupled to an actuator such as a clutch brake 606. In response to a control signal on line 19 from computer 80 (FIG. 2), the clutch brake 606 (FIG. 16) is activated to couple a drive shaft 608 to the motor 9. An eccentric 610 is driven by the drive shaft 608 through one revolution in response to the control signal 19. As the eccentric rotates, an arm 612 is driven by the eccentric in reciprocation. The arm 612 (and a similar arm at the opposite end of the slot former 280') are coupled to the die and reciprocate through one stroke to lower the die into slot forming engagement with band 74 and to then raise the die away from the band. As in the case of the other similar actuators, bearings may couple the eccentric to the arms. The second slot forming die may be detachably mounted in slot former 280' for replacement with a different die in the event a differently configured second card is to be made. At least one second band advancer or feeder 282', in this case only one such feeder is used, draws the band of material 74 past the slot former 280', over a guide roller 614 and positions the band for singulation by a blade 422' of a second card singulator 420'. The second card singulator 420' operates in response to a signal on line 20 from computer 80 (FIG. 2) to cut the band 74 into each individual second card following its insertion into the sets of first cards (e.g., see card 46 in FIG. 16) at a second card insertion location indicated generally at 620 in FIG. 16. The second cards may alternatively be individualized before insertion with an additional delivery mechanism then being used to insert the singulated second cards into the first cards. The illustrated card material feeder 282' includes two rollers 284', 286' with at least one and preferably both of the rollers being driven by a motor 10 in response to a control signal from the computer 80 (FIG. 2) via a control line 25. Material feeder 282' may be identical to feeder 282 described above. The computer 80 operates to cause the feeder 282' to insert a portion of the band 74 into the first card slots and to cause the severing of the band into the second card. The apparatus is then indexed to place the next empty set of slots 48 of the set of first cards in position for receiving a second card.

As previously mentioned, a commercially available mechanism, such as a clutch brake from Warner Electric, may be used for coupling a motor to an actuator for one revolution of a shaft. An example of such a mechanism is shown in FIG. 16A. More specifically, a solenoid 622 operates a plunger 624 in response to a signal on line 20. When the plunger is retracted from the position shown in FIG. 16A, a trigger 626 pivots about a trigger pivot 628 to permit the movement of the shaft 440' through one revolution of the shaft before the trigger is re-engaged.

Card Assembly Station

One specific embodiment of a partition assembly module 66 and card mover 67 is best understood with reference to FIGS. 1 and 11–15.

The illustrated assembly module 66 includes an elongated frame 680 (FIGS. 11, 12) which supports first and second endless drive loops, such as drive chains 682, 684, drivingly supported by the frame at opposite sides of the frame. The drive chains support a plurality of card movers such as pusher bars with some of the pusher bars being indicated by the number 686 in FIGS. 11 and 12.

Figure 14:
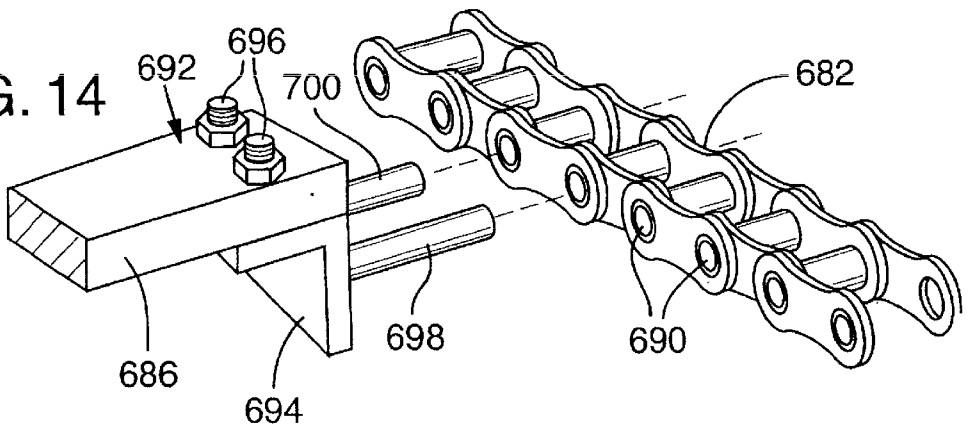
FIG. 14 illustrates a portion of one form of partition mover included in the card mover of FIG. 11 and illustrating a mechanism for detachably coupling the partition mover to drive chains included in the card mover of FIG. 11.

With reference to FIG. 14, the chains 682, 684 may comprise a plurality of interconnected links with openings, some being indicated at 690 in FIG. 14. Chains such as chain 682 in FIG. 14 are commercially available with an RC 40 hollow pin chain being a specific example. The respective end portions 692 of pusher bars 686 are detachably coupled to the associated chains. For example, an inverted L-shaped mounting bracket or coupler 694 may be mounted to the respective end portions of the pusher bars such as by fasteners 696. At least one and in the illustrated example a pair of inserts 698, 700 project outwardly from bracket 694. Inserts 698, 700 are inserted into respective insert receiving openings 690 of the chain 682 to detachably couple the chain to the pusher bar 686. The opposite end portion of pusher bar 686 may be coupled to chain 684 in the same manner. The chains are supported on the conveyor such that at least one and preferably both of the chains may be spread apart from one another a sufficient distance to remove the inserts 698, 700 from the openings 690 to thereby detach the pusher bar 686 from the chain. This provides a convenient mechanism for adjusting the position of the pusher bars along the chain to accommodate sets of first cards of varying lengths. Other detachment mechanisms may also be used.

Figures 11, 12:
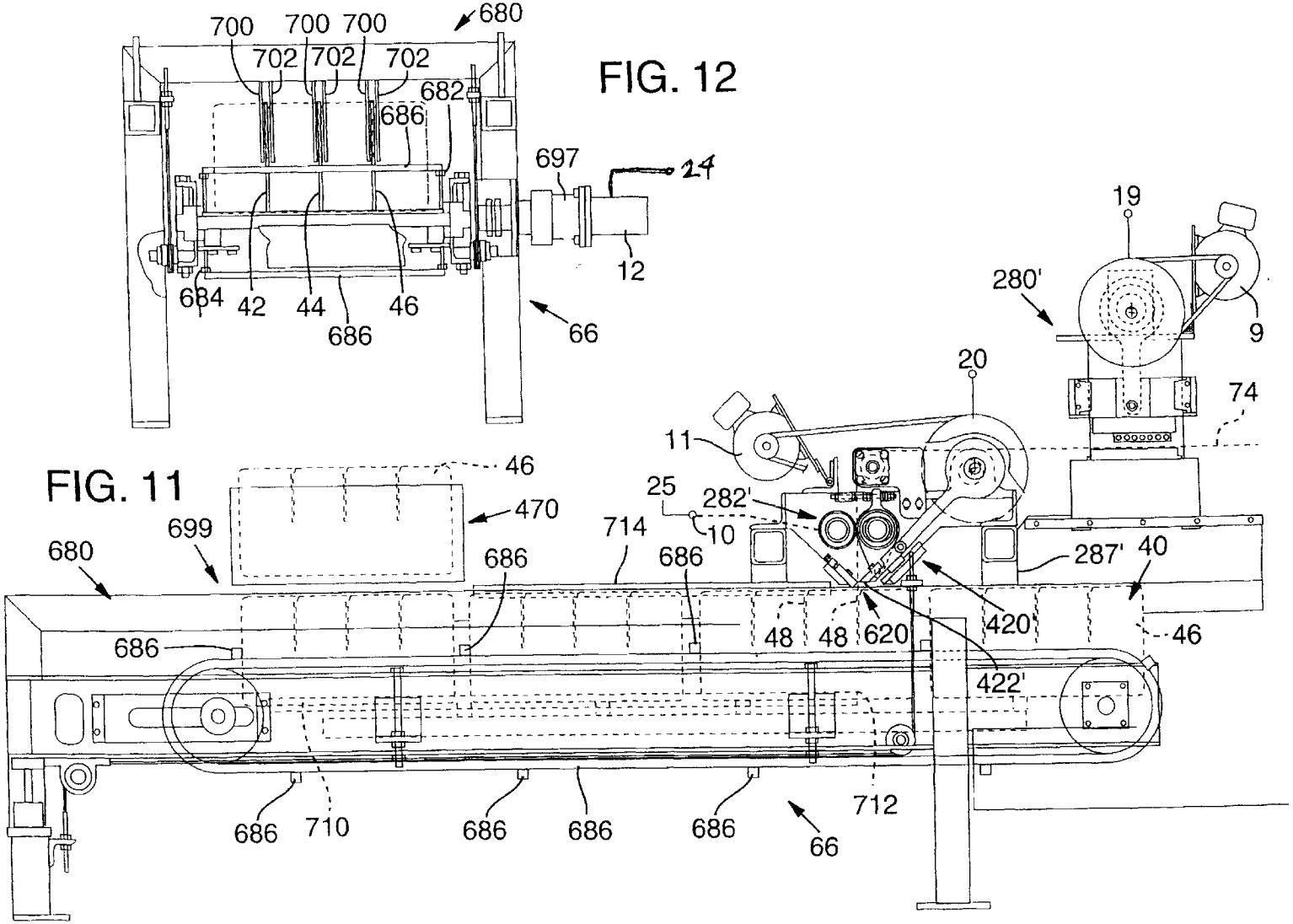
FIG. 11 is a side elevation view of one form of card assembly module together with an embodiment of a second card forming module for the apparatus of FIG. 1.
FIG. 12 is an end view of a card mover included in the assembly module of FIG. 11.

As can be seen in FIG. 11, as the chain 682 is driven clockwise in this figure, the pusher bars 686 which are in an upper position of the conveyor engage rear edges of the sets of first cards and move the sets of first cards along the conveyor as the chain is driven. Typically a space of about two to three inches is maintained between the respective sets of first cards although this space may be varied. The conveyor chains are coupled to drive pulleys which are selectively driven by a motor 12 (FIGS. 1, 12) to index the slots 48 at the second card insertion location 620 for receiving second cards. Following the insertion of a second card, the sets of first cards are indexed to place the next transversely aligned sets of slots 48 in position for receiving the next second card. The motor 12, responsive to a control signal on line 24 from computer 80 (FIG. 2), drives the chains 682, 684. The motor 12 may be a servo motor like motor 3 coupled through a gear reducer 697 (e.g., a 15 to 1 gear reducer) to a shaft to which chain supporting drive pulleys are mounted.

Upper guides may be provided for guiding the delivery of first cards as they enter the conveyor. These upper guides may each include a set of first and second spaced apart plates 700, 702 which define a slot therebetween. As the first cards are delivered from the card transferor 470 of module 62, they pass into a respective one of the slots and are held upright at their upper end by the plates 700, 702. An elongated base guide 710 may also be provided. One such base guide 710 may be provided for each card of the set of first cards that are received. For example, for an apparatus which assembles up to three first cards, three such base guides 710 may be provided with one base guide being provided for each card of the set. The illustrated base guide 710, as shown in dashed lines in FIG. 11, commences at the first card receiving location 699 and terminates at a location 712 which is just shy of the second card insertion location 620. Each guide 710 defines an elongated slot (described below) which supports the bottom edge of the received first card in an upright orientation for guiding the received card along the conveyor and for rigidly supporting the received card sufficiently to facilitate the insertion of the second cards at the second card insertion location. In addition, an elongated second upper guide 714, which may comprise a plurality of guides like the guides 710, receive the top edge of the respective first cards as they advance along the conveyor and exit from the slot defined by the plates 700, 702. The transverse spacing between the slots defined by plates 700, 702 may differ from the desired transverse spacing between the first cards of the finished partition. The guides 710 and 714 may adjust the transverse spacing between the first cards from the spacing present between the first cards at the first card receiving location 699 and the spacing between the cards at the second card insertion location 620.

Figure 15:
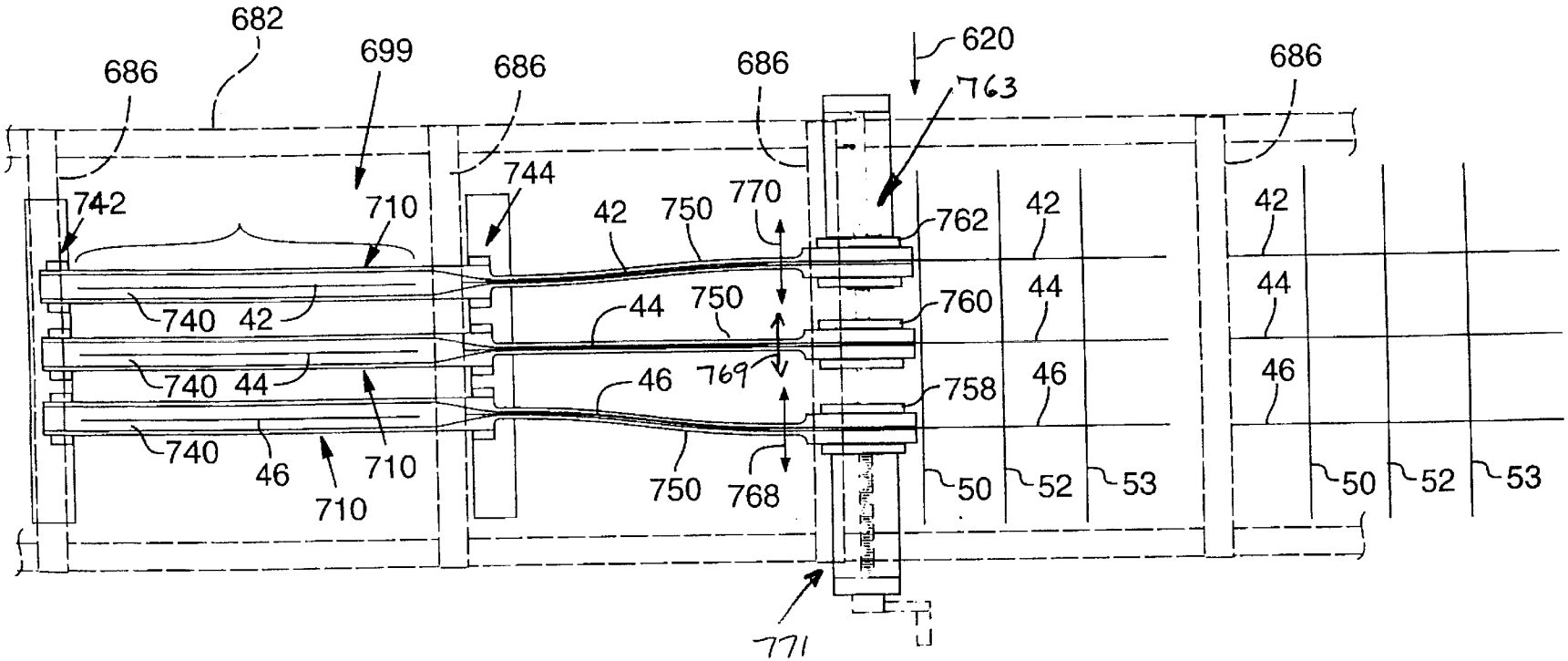
FIG. 15 schematically illustrates the card mover of FIG. 11 looking down from above and shows one approach for adjusting the transverse spacing between cards of the first set of cards as they travel from a first card receiving location to a second card insertion location.

This transitioning of the first card transverse spacing moving from the first card receiving location 699 to the second card insertion location 620 is illustrated in FIG. 15. At location 699, the guides 710, 714 define respective guide channels 740 which are spaced apart a first distance to establish the transverse spacing between the respective cards 42, 44, and 46. The guides 710 may be fixed to the conveyor frame at locations 742, 744 so that the transverse spacing between channels 740 and thus between the sets of first cards at location 699 is fixed. This facilitates insertion of sets of first cards into the guides at this location as the space between the card receptacles 380 (FIG. 1) may be set to correspond the spacing between the sets of plates 700, 702 and between slots 740 at location 699. The transverse spacing between first cards 42, 44, and 46 at the second card insertion location 620 may be the same as the spacing at location 699 or may differ. Each of the illustrated guide sections 710 includes a transition region 750 extending between location 699 and location 620. The transition region 750 together with upper guides 714 guides the sets of first cards along the conveyor and may vary the transverse spacing between the cards as they travel along the conveyor. For example, the transition sections 750, and for that matter each entire lower guide 710, may be of a unitary one-piece construction and of a polymer material, such as UHMW polyethylene. In such a case, the transition sections 750 are bendable. Upper guides 714 may also be constructed of UHMW polyethylene or other bendable material. In the illustrated embodiment, clamps 758, 760, 762 couple the respective transition sections 750 to the frame at location 763. The clamps may be released and the transverse spacing between the respective guide sections 750 adjusted as indicated by arrows 768, 769, 770. The clamps may then clamp these sections to the frame to establish the desired transverse spacing. Alternatively, screw jack or other adjustment mechanisms may be used. One such screw jack is indicated in dashed lines at 771 for shifting the spacing of the lowermost guide in this figure. Typically, one screw jack would be provided for each guide. As a result, the transverse spacing between slots defined in the downstream ends of the transition sections 750 is adjusted to thereby adjust the transverse spacing between the first cards of the set. The second upper guides 714 may also comprise individual transition sections like the sections 750 with the transverse spacing between these guides being adjusted using screw jacks or other adjustment mechanisms in the same manner as described above for the transition regions 750 of guides 710.

Figure 13:
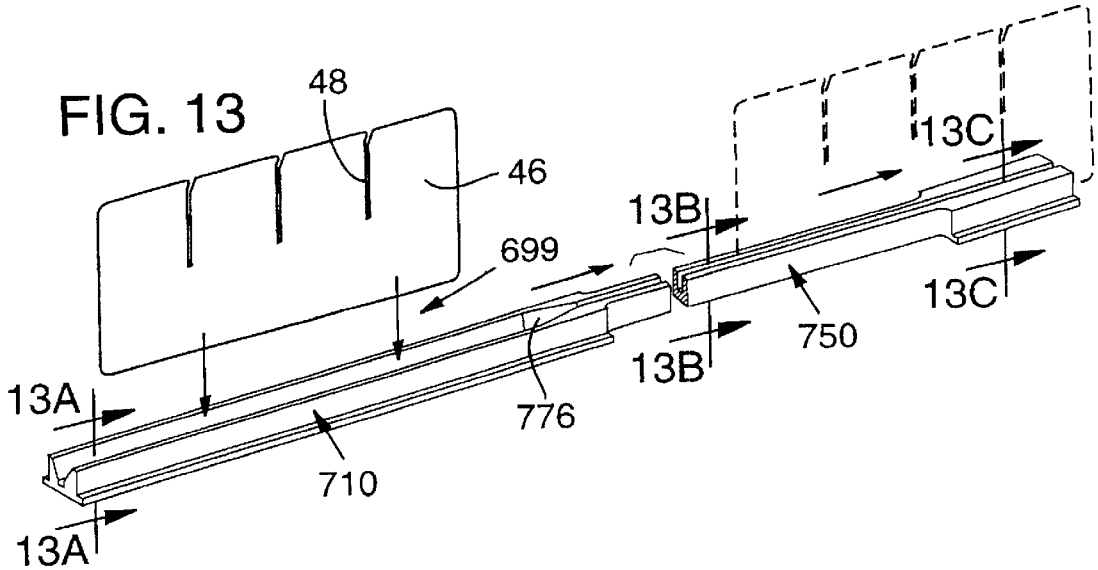
FIG. 13 illustrates one form of an elongated guide slot for supporting first cards in an upright orientation as they are transported along the card mover.
Figure 13A:
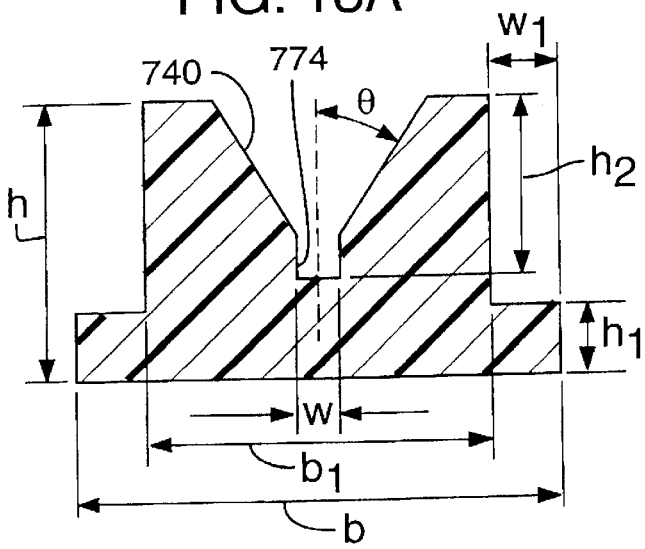
FIGS. 13A–13C illustrates cross-sections through the guide of FIG. 13 taken along respective lines 13A—13A, 13B—13B, and 13C—13C of FIG. 13.
Figure 13B:
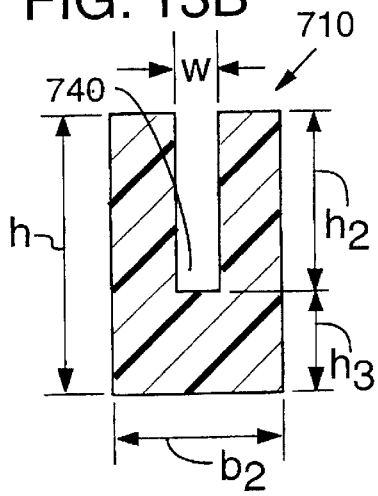
Figure 13C:
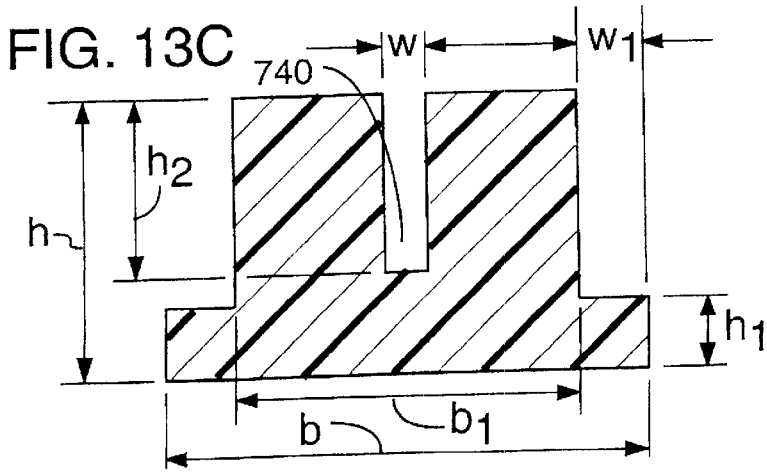

FIGS. 13–13C more specifically illustrate one suitable form of the guides 710. The cross-sectional configuration of the various sections of the guides 710 shown in FIG. 13 are shown in FIGS. 13A, 13B and 13C.

As can be seen with reference to FIG. 13A, at the first card insertion location 699, the walls bounding card receiving slot 740 are sloped from vertical for approximately the upper three-fourths of their height. For example, they may be sloped at an angle θ which is approximately 30° from vertical. As a result, the lower edges of the first cards are guided by the sloping walls into a narrow portion 774 of the slot 740 at the base of the slot. As indicated at 776 in FIG. 13, the walls defining slot 740 converge toward one another moving from the initial guide section of guide 710 at location 699 to the transition section 750. As can be seen in FIG. 13B, the walls defining slot 740 are essentially vertical in the illustrated embodiment in the transition region. These walls, together with correspondingly shaped walls of second upper guides 714, hold the first cards in the desired erect position. Similarly, the portion of the guide 710 shown in FIG. 13C where the cards exit from the guide have a slot 740 defined by vertical walls. Although the dimensions of these components may be varied, as a specific example the dimensions may correspond to the following table, with the letters in the table referring to corresponding letters set forth in FIGS. 13A, 13B and 13C:

| | |
|---|---|
| h | 0.875 in. |
| $h_1$ | 0.250 in. |
| $h_2$ | 0.687 in. |
| $h_3$ | 0.187 in. |
| b | 1.812 in. |
| $b_1$ | 0.250 in. |
| $b_2$ | 0.750 in. |
| w | 0.125 in. |
| $w_1$ | 0.250 in. |

The above dimensions may be varied but provide a specific example of one suitable guide 710 for use in the apparatus of FIG. 1.

With reference to FIG. 1, a sensor, such as a photocell, may be positioned adjacent to the second card insertion location and, for example, upstream of the insertion location. A suitable sensor is indicated at 790 in FIG. 1. Upon detection of the insertion of a second card, a signal is sent via control line 29 to the computer 80. In the event the second singulator 420' is operated and the insertion of a second card is not detected by sensor 790, a potential jam condition is indicated. The computer may then, as an example, shut down the operation of the apparatus to permit investigation and/or clearing of the jam. Another sensor, such as a photocell 792, may be positioned at the first card receiving location 699 and, for example, immediately downstream from such location. Sensor 792 may be focused, for example, at a location which is slightly above the upper edge of the pusher bar. Alternatively, sensor 792 (as is the case for other sensors of the apparatus) may be positioned at other locations. For example, sensor 792 may be positioned to focus along the top edge of a pusher bar when the first cards are in the home position shown in FIG. 1 with the first slots of a set of first cards at the location at which a second card is, to be inserted. If sensor 792 detects the presence of a first card, this indicates that a first card has not been fully inserted into the guide track. For example, the first card may be hung up on one of the pusher bars. A signal is sent via control line 28 to the computer 80 in the event an improperly positioned first card is detected. The computer may then shut down the apparatus in response to such a signal to permit clearing of the improperly seated card. Also, a home position sensor (not shown) may be positioned to focus along the front edge of a pusher bar when in the home position to provide a reference signal to the computer. The system may be "jogged" during initial setup for each type of partition type to place the pusher bar in the home position to provide the reference for the partition type from which other components may be indexed during partition manufacture.

With reference to FIG. 4, the computer 80 may be programmed to establish the appropriate indexing for the components of the apparatus of FIG. 1 depending upon partition parameters entered into the system for a given partition type. For example, a different lookup table may be used for each partition type. In this case, an operator of the system need only key in or otherwise identify the partition type with the computer then, from the corresponding lookup table, establishing the various control parameters. With reference to FIG. 4, the "long height" is specified as one entry in the lookup table. The long height corresponds to the height of one of the first cards and thus to the quantity of material which is advanced by first card advancer 282 between each operation of the singulator 420 to form an individual card. This information also establishes the height of the section moved with each indexing into the slot former 280. A second entry in the lookup table is "NO L CARDS." This entry corresponds to the number of long cards or first cards which are included in the set of first cards for the specified type of partition. In FIG. 3, as explained above, three such first cards 42, 44, and 46 are included. The third entry in the table of FIG. 4 is designated "L INSIDE CELL." This entry corresponds to the dimension or distance between the slots 48 in the first cards. From this information, the distance through which the conveyor is indexed to position successive slots at the short card insertion location is established. A "SHORT HEIGHT" entry in the table of FIG. 4 corresponds to the height of the crosscards or second cards (e.g., cards 50, 52 and 53 in FIG. 3). From this information the operation of second card material advancer 282' is established so that the proper amount of material is delivered to singulator 420' as each individual second card is formed. The fifth entry in the table is "NO S CARDS." This entry corresponds to the number of short cards or crosscards which are to be included in the assembled partition. For example, in FIG. 3 cards 50, 52 and 53 are the short or second cards. Entry number six in the FIG. 4 table is "BUNDLE COUNT." If an automatic bundling machine is used to collapse and bundle partitions following their assembly and delivery from the assembly station 66, the bundler would be operated to bundle the partitions after the bundle count is reached. Entry number seven in the FIG. 4 table is "BAR SPACING." This entry corresponds to the pusher bar spacing, that is the spacing between the pusher bars on the conveyor 67 of module 66. This information together with the L INSIDE CELL dimension information is used in controlling the indexing of the sets of first cards by the conveyor. For example, after all of the second cards have been inserted into a given partition, the conveyor is indexed an amount to position the slots 48 of the next set of first cards in position for the insertion of a second card. The final entry in the table of FIG. 4 is designated "CELL NO. TO NIP." The cell number to nip information relates to controlling when the nip rollers 472, 474, 476 (FIG. 7) are shifted upwardly to transfer the next set of first cards to the conveyor relative to the number of the cell or slot of the first cards into which second cards are being inserted at the card insertion location. Typically, when the first slots of the first cards are in position to receive a crosscard, the next set of first cards is transferred and the CELL NO. TO NIP is one. However, for some partition configurations a pusher bar may be in the way of the card transfer to the conveyor unless the card transfer to the conveyor occurs when second or subsequent slots of the set of first cards are at the second card insertion location. In such cases, the CELL NO. TO NIP entry would be two or some other number.

As one specific example, the FIG. 4 lookup table for an exemplary two first card by three crosscard partition may be as follows:

| | |
|---|---|
| 1 LONG CARD HEIGHT #6. #250 | (6.25 inches) |
| 2 NO L CARDS #2 | |

-continued

| | |
|---|---|
| 3 L INSIDE CELL #3. #625 | (3.625 inches) |
| 4 SHORT HEIGHT #6. #250 | (6.25 inches) |
| 5 NO S CARDS #3. | |
| 6 BUNDLE COUNT #50. | |
| 7 BAR SPACING #18. | (18 inches) |
| 8 CELL NO. TO TIP #1. | |

One merely needs to enter the identification for this partition type and the above settings are obtained from the lookup table.

Thus, it is apparent that the apparatus of FIG. 1 provides an extremely efficient single pass apparatus for assembling partitions for boxes or other containers. During initial setup, in a conventional manner, a jog switch may be employed to index the various components to position cards for commencement of the partition manufacturing operation. For example, the system may be jogged until the conveyor is loaded with sets of first cards with a set of first cards having their first slot at the second card insertion location. In addition, modules 70 and 72 may be jogged until the band of material 76 to be formed into as first of the second cards is positioned into the first set of slots of the first set of first cards. At this point the system may be automatically operated, commencing with the singulation of the second card.

In addition, the various continuously operating motors of the apparatus may be operated by a circuit which starts each motor separately in a stepped fashion so that two motors are not initially energized simultaneously. This approach reduces the overall current draw of the system when the motors commence operation.

Although we have described our invention with reference to several preferred embodiments of a partition manufacturing apparatus and of various components of such an apparatus, it should be apparent that the disclosed embodiments may be modified in arrangement and detail without departing from the principles of our invention. For example, first cards may be formed and inserted into the conveyor slots without a carousel. That is, the first cards may be inserted into upright pockets or receptacles, for example, from above in the same manner as the second cards are delivered above. The receptacles may be indexed and opened at the bottom (e.g., gates may be opened at the bottom of the pockets) to deposit sets of first cards into the conveyor slots. This also eliminates a roller type transferor.

We claim all such modifications which fall within the scope and spirit of the following claims:

What is claimed is:

1. An apparatus for making partitions for containers, the partitions each having a first set of first cards and a second set of second cards, the first set including at least one first card having at least one first card slot and the second set including at least one second card having at least one second card slot, the first and second sets of cards interfitting with one another at the respective first and second card slots to form a partition, the apparatus comprising:

a first card stock supplier adapted to deliver an elongated first band of first card stock forming material from a first roll of such material, the first card stock supplier including a first card stock advancer adapted to advance the first band from the first roll;

a first slot former adapted to repetitively engage the first band and cut the at least one first card slot in successive sections of the first band, each section corresponding to a portion of the first band from which a respective first card is to be formed;

at least one first band feeder adapted to selectively advance the first band past the first slot former;

a first card singulator adapted to selectively sever the sections of the first band into respective first cards;

a first card transporter adapted to receive the singulated first cards from the first card singulator at a first location and to transport the singulated first cards from the first location to a delivery location;

a card assembly station having a first card receiving location and a second card insertion location, the card assembly station including a card mover adapted to move respective sets of first cards from the first card receiving location to the second card insertion location and to orient the respective first sets of cards such that they are in an upright orientation at the second card insertion location;

a first card transferor adapted to transfer first cards from the delivery location to the first card receiving location with the first cards oriented in an upright orientation at the first card receiving location;

a second card stock supplier adapted to provide an elongated second band of second card stock forming material from a second roll of such material, the second card stock supplier including a second card stock advancer adapted to advance the band of second card stock forming material from the second roll;

a second slot former adapted to repetitively engage the second band and cut the at least one second card slot in successive sections of the second band, each section corresponding to a portion of the second band from which a respective second card is to be formed;

at least one second band feeder adapted to selectively advance the second band past the second slot former;

a second card singulator adapted to selectively sever the sections of the second band into respective second cards and to deliver the singulated second cards to the second card insertion location and in an upright orientation at the second card insertion location, at which the first and second sets of cards are combined to form the partition and wherein the first and second sets of cards are positioned in an upright orientation when they are combined to form the partition;

a programmed computer controller coupled to the first card stock supplier and operable to control the first card advancer, coupled to the first slot former and operable to control the first slot former to cut the first card slots, coupled to the at least one first band feeder and operable to control the advancing of the first band past the first slot former, coupled to the first card singulator and operable to control the first card singulator to control the severing of the sections of the first band into the respective first cards, coupled to the first card transporter and operable to control the first card transporter to control the transportation of the singulated first cards from the first location to the delivery location, coupled to the first card transferor to control the delivery of sets of first cards from the delivery location to the first card receiving location, coupled to the card mover and operable to control the moving of sets of first cards from the first card receiving location to the second card insertion location, coupled to the second card stock supplier and operable to control the second card advancer, coupled to the second slot former and operable to control the second slot former to cut the second card slots, coupled to the at least one second band feeder and operable to control the advancing of the second band past the second slot former, coupled to the second card singulator and operable to control the severing of the sections of the second band into the respective second cards and to control the delivery of singulated second cards to the second card insertion location, whereby the computer controller is operable to control the production of completed partitions.

2. An apparatus for making partitions for containers, the partitions each having a first set of first cards and a second set of second cards, the first set including at least one first card having at least one first card slot and the second set including at least one second card having at least one second card slot, the first and second sets of cards interfitting with one another at the respective first and second card slots to form a partition, the apparatus comprising:

a first card stock supplier adapted to deliver an elongated first band of first card stock forming material from a first roll of such material, the first card stock supplier including a first card stock advancer adapted to advance the first band from the first roll;

a first slot former adapted to repetitively engage the first band and cut the at least one first card slot in successive sections of the first band, each section corresponding to a portion of the first band from which a respective first card is to be formed;

at least one first band feeder adapted to selectively advance the first band past the first slot former;

a first card singulator adapted to selectively sever the sections of the first band into respective first cards;

a first card transporter adapted to receive the singulated first cards from the first card singulator at a first location and to transport the singulated first cards from the first location to a delivery location;

a card assembly station having a first card receiving location and a second card insertion location, the card assembly station including a card mover adapted to move respective sets of first cards from the first card receiving location to the second card insertion location;

a first card transferor adapted to transfer first cards from the delivery location to the first card receiving location;

a second card stock supplier adapted to provide an elongated second band of second card stock forming material from a second roll of such material, the second card stock supplier including a second card stock advancer adapted to advance the band of second card stock forming material from the second roll;

a second slot former adapted to repetitively engage the second band and cut the at least one second card slot in successive sections of the second band, each section corresponding to a portion of the second band from which a respective second card is to be formed;

at least one second band feeder adapted to selectively advance the second band past the second slot former;

a second card singulator adapted to selectively sever the sections of the second band into respective second cards and to deliver the singulated second cards to the second card insertion location at which the first and second sets of cards are combined to form the partition;

a programmed computer controller coupled to the first card stock supplier and operable to control the first card advancer, coupled to the first slot former and operable to control the first slot former to cut the first card slots, coupled to the at least one first band feeder and operable to control the advancing of the first band past the first slot former, coupled to the first card singulator and operable to control the first card singulator to control the severing of the sections of the first band into the respective first cards, coupled to the first card transporter and operable to control the first card transporter to control the transportation of the singulated first cards from the first location to the delivery location, coupled to the first card transferor to control the delivery of sets of first cards from the delivery location to the first card receiving location, coupled to the card mover and operable to control the moving of sets of first cards from the first card receiving location to the second card insertion location, coupled to the second card stock supplier and operable to control the second card advancer, coupled to the second slot former and operable to control the second slot former to cut the second card slots, coupled to the at least one second band feeder and operable to control the advancing of the second band past the second slot former, coupled to the second card singulator and operable to control the severing of the sections of the second band into the respective second cards and to control the delivery of singulated second cards to the second card insertion location, whereby the computer controller is operable to control the production of completed partitions;

wherein at least one of the first and second card stock suppliers comprises:

a roll carrier adapted to rotatably carry a respective roll of first or second card forming material;

a card forming material advancer adapted to rotate the roll to deliver the respective first or second band from the roll;

first and second band supports each adapted to support the respective first or second, the respective first or second band being delivered from the second support toward a respective one of the first and second slot formers;

the card forming material advancer rotating the roll at a variable rate to provide a festoon of card forming material extending downwardly between the first and second band supports;

a plurality of festoon sensors each positioned at a different elevation and adapted to sense the presence of the festoon at the elevation of the sensor, each sensor providing a sensor output signal indicating the sensing of the festoon by the sensor; and wherein the controller is responsive to the sensor output signals and adapted to control the card forming material advancer to control rate of delivery of the respective first or second bands in response to the sensor output signals.

3. An apparatus according to claim 2 in which the card forming material advancer includes first and second material feed rolls which form a nip therebetween, the respective first and second bands of material passing through the nip, at least one of the first and second material feed rolls being rotatable to pull the respective first or second band from the roll and rotate the roll as the band is pulled from the roll, a computer controlled motor adapted to drive the rotation of said at least one of the first and second material feed rolls, the controller being coupled to the sensors for receiving the sensor output signals and to the motor for controlling the operation of the motor in response to the sensor output signals.

4. An apparatus according to claim 3 in which the motor comprises a variable frequency motor.

5. An apparatus according to claim 2 in which said at least one of the first and second card stock suppliers comprises at least three such sensors, the first sensor being at a first elevation, the second sensor being at a second elevation below the first elevation and the third sensor being at a third elevation below the second elevation, whereby detection of the festoon by the third sensor indicates a festoon which is larger than a festoon which is detected by any of the first and second sensors and not by the third sensor, and whereby detection of the festoon by the second sensor indicates a festoon which is larger than a festoon which is detected by the first sensor and not by the second sensor, the controller being operable to control the card forming material advancer to control the rate of delivery of the respective first or second band at a first rate in the event the festoon is detected by the second sensor and not by the third sensor, at a second rate which is greater than the first rate in the event the festoon is detected by the first sensor and not by the second sensor, and at a third rate which is less than the first rate in the event the festoon is detected by the third sensor.

6. An apparatus according to claim 5 wherein at least one of the first and second card stock suppliers also includes a fourth sensor positioned below the third sensor and wherein the controller interrupts the delivery of the respective first or second band in the event the festoon is detected by the fourth sensor.

7. An apparatus according to claim 5 in which the second rate is about two times the first rate and the third rate is about one-half the first rate.

8. An apparatus for making partitions for containers, the partitions each having a first set of first cards and a second set of second cards, the first set including at least one first card having at least one first card slot and the second set including at least one second card having at least one second card slot, the first and second sets of cards interfitting with one another at the respective first and second card slots to form a partition, the apparatus comprising:

a first card stock supplier adapted to deliver an elongated first band of first card stock forming material from a first roll of such material, the first card stock supplier including a first card stock advancer adapted to advance the first band from the first roll;

a first slot former adapted to repetitively engage the first band and cut the at least one first card slot in successive sections of the first band, each section corresponding to a portion of the first band from which a respective first card is to be formed;

at least one first band feeder adapted to selectively advance the first band past the first slot former;

a first card singulator adapted to selectively sever the sections of the first band into respective first cards;

a first card transporter adapted to receive the singulated first cards from the first card singulator at a first location and to transport the singulated first cards from the first location to a delivery location;

a card assembly station having a first card receiving location and a second card insertion location, the card assembly station including a card mover adapted to move respective sets of first cards from the first card receiving location to the second card insertion location;

a first card transferor adapted to transfer first cards from the delivery location to the first card receiving location;

a second card stock supplier adapted to provide an elongated second band of second card stock forming material from a second roll of such material, the second card stock supplier including a second card stock advancer adapted to advance the band of second card stock forming material from the second roll;

a second slot former adapted to repetitively engage the second band and cut the at least one second card slot in successive sections of the second band, each section corresponding to a portion of the second band from which a respective second card is to be formed;

at least one second band feeder adapted to selectively advance the second band past the second slot former;

a second card singulator adapted to selectively sever the sections of the second band into respective second cards and to deliver the singulated second cards to the second card insertion location at which the first and second sets of cards are combined to form the partition;

a programmed computer controller coupled to the first card stock supplier and operable to control the first card advancer, coupled to the first slot former and operable to control the first slot former to cut the first card slots, coupled to the at least one first band feeder and operable to control the advancing of the first band past the first slot former, coupled to the first card singulator and operable to control the first card singulator to control the severing of the sections of the first band into the respective first cards, coupled to the first card transporter and operable to control the first card transporter to control the transportation of the singulated first cards from the first location to the delivery location, coupled to the first card transferor to control the delivery of sets of first cards from the delivery location to the first card receiving location, coupled to the card mover and operable to control the moving of sets of first cards from the first card receiving location to the second card insertion location, coupled to the second card stock supplier and operable to control the second card advancer, coupled to the second slot former and operable to control the second slot former to cut the second card slots, coupled to the at least one second band feeder and operable to control the advancing of the second band past the second slot former, coupled to the second card singulator and operable to control the severing of the sections of the second band into the respective second cards and to control the delivery of singulated second cards to the second card insertion location, whereby the computer controller is operable to control the production of completed partitions;

wherein the first and second card singulators each include a knife and a knife actuator, the knife actuator being adapted to selectively move the knife into engagement with the respective first and second bands to sever the sections and thereby the individual cards from the respective first and second bands of material; and the controller being programmed to control the knife actuator and knife to control the severing of the respective bands into first and second cards.

9. An apparatus according to claim 8 wherein the first band feeder comprises at least one card material feeder positioned between the first slot former and the first card singulator, the first card transporter having a plurality of card holders which receive and transport the singulated first cards from the first location to the delivery location, the controller being programmed to cause the at least one first band feeder to advance respective sections of the first band of material through the first slot former and into a respective card holder prior to severing of the section of the first band;

a first card detector for detecting the presence of the respective sections of the first band of material in the respective card holders and for providing a card presence signal indicating the presence of a section of the first band of material in a card holder, the controller being adapted to receive the card presence signals and to interrupt the operation of the apparatus in the event a card presence signal is not received prior to the time the knife actuator is actuated to sever a card from the first band.

10. An apparatus according to claim 9 which includes only one first band feeder.

11. An apparatus according to claim 10 in which the first band feeder includes rollers comprising elongated gears with a plurality of elongated teeth and wherein the lands are formed by removing material from the teeth.

12. An apparatus according to claim 8 in which each knife includes a knife blade which extends transversely across the band of material, each knife actuator comprising first and second spaced apart knife supporting arms coupled to the associated knife blade, the knife supporting arms being supported for reciprocation and positioned such that the knife blade severs one of the sections into a card as the knife supporting arms reciprocate, each knife actuator including an eccentric coupled to the associated knife supporting arms so as to reciprocate the knife supporting arms upon rotation of the eccentric, a motor, and a clutch brake controlled by the controller so as to selectively couple the motor to the eccentric to drive the eccentric and reciprocate the knife supporting arms.

13. An apparatus for making partitions for containers, the partitions each having a first set of first cards and a second set of second cards, the first set including at least one first card having at least one first card slot and the second set including at least one second card having at least one second card slot, the first and second sets of cards interfitting with one another at the respective first and second card slots to form a partition, the apparatus comprising:

a first card stock supplier adapted to deliver an elongated first band of first card stock forming material from a first roll of such material, the first card stock supplier including a first card stock advancer adapted to advance the first band from the first roll;

a first slot former adapted to repetitively engage the first band and cut the at least one first card slot in successive sections of the first band, each section corresponding to a portion of the first band from which a respective first card is to be formed;

at least one first band feeder adapted to selectively advance the first band past the first slot former;

a first card singulator adapted to selectively sever the sections of the first band into respective first cards;

a first card transporter adapted to receive the singulated first cards from the first card singulator at a first location and to transport the singulated first cards from the first location to a delivery location;

a card assembly station having a first card receiving location and a second card insertion location, the card assembly station including a card mover adapted to move respective sets of first cards from the first card receiving location to the second card insertion location;

a first card transferor adapted to transfer first cards from the delivery location to the first card receiving location;

a second card stock supplier adapted to provide an elongated second band of second card stock forming material from a second roll of such material, the second card stock supplier including a second card stock advancer adapted to advance the band of second card stock forming material from the second roll;

a second slot former adapted to repetitively engage the second band and cut the at least one second card slot in successive sections of the second band, each section corresponding to a portion of the second band from which a respective second card is to be formed;

at least one second band feeder adapted to selectively advance the second band past the second slot former;

a second card singulator adapted to selectively sever the sections of the second band into respective second cards and to deliver the singulated second cards to the second card insertion location at which the first and second sets of cards are combined to form the partition;

a programmed computer controller coupled to the first card stock supplier and operable to control the first card advancer, coupled to the first slot former and operable to control the first slot former to cut the first card slots, coupled to the at least one first band feeder and operable to control the advancing of the first band past the first slot former, coupled to the first card singulator and operable to control the first card singulator to control the severing of the sections of the first band into the respective first cards, coupled to the first card transporter and operable to control the first card transporter to control the transportation of the singulated first cards from the first location to the delivery location, coupled to the first card transferor to control the delivery of sets of first cards from the delivery location to the first card receiving location, coupled to the card mover and operable to control the moving of sets of first cards from the first card receiving location to the second card insertion location, coupled to the second card stock supplier and operable to control the second card advancer, coupled to the second slot former and operable to control the second slot former to cut the second card slots, coupled to the at least one second band feeder and operable to control the advancing of the second band past the second slot former, coupled to the second card singulator and operable to control the severing of the sections of the second band into the respective second cards and to control the delivery of singulated second cards to the second card insertion location, whereby the computer controller is operable to control the production of completed partitions; and wherein the first card transporter comprises first and second spaced apart rotatable card holder support wheels each having a periphery, a transporter drive including a transporter drive shaft, a transporter drive motor, a first endless transporter drive loop coupled to the transporter drive shaft and to the first card holder support wheel and a second endless drive loop coupled to the transporter drive shaft and to the second card holder support wheel, the card holders each comprising a set of first and second card supports positioned to extend at least in part between the first and second drive loops, a card receiving opening being provided between the first and second card supports of the set, a plurality of sets of first and second card supports being coupled to the first and second drive loops at spaced locations along the drive loops, the controller selectively coupling the motor to the drive shaft to advance the first and second drive loops to position a set of first and second card supports and thereby the card receiving opening and card holder in the card receiving position, and to advance card containing holders to the card transfer location, the first and second card supports being positioned on the first and second card holder support wheels such that a majority of each card in a card holder is positioned inwardly of the periphery of the card holder support wheels.

14. An apparatus according to claim 13 in which the first and second card supports each comprise a resilient tube and at least one card gripper mounted to each tube.

15. An apparatus according to claim 13 in which the first card transferor comprises a support, a plurality of sets of card transfer rollers rotatably carried by the support, each set of card transfer rollers including a first roller and a second roller which define a card transfer nip therebetween, a card transfer roller driver coupled to the sets of rollers so as to drive each set of rollers so as to transfer cards engaged by the sets of rollers in a first direction through the card transfer nips of the sets of rollers, a card transfer roller support mover controlled by the controller to selectively move the sets of rollers into position to engage cards at the card transfer location in the card transfer nips, whereby the engaged cards are transferred to the card delivery location, the card transferor including only one set of first and second rollers for each card to be engaged and transferred in the first direction.

16. An apparatus according to claim 13 including a first card transfer sensor positioned to sense the presence of a card in the first card transporter that should have been transferred by the card transferor, the card transfer sensor producing a card transfer error output signal upon the detection of such a card, the controller interrupting the operation of the apparatus in response to the card transfer error output signal.

17. An apparatus according to claim 13 in which the card mover comprises a conveyor for moving a set of first cards, each set containing at least one first card, from the first card receiving location to the second card insertion location at which second cards are inserted into the first set of cards, the conveyor comprising:

an elongated conveyor frame having a longitudinal or lengthwise axis;

first and second spaced apart elongated endless drive chain loops extending lengthwise along the frame, each drive chain loop being comprised of a plurality of interconnected chain links with the links including insert receiving openings, at least one of the drive chain loops being movable in a transverse direction so as to permit spreading apart of the drive chain loops, a plurality of spaced apart partition movers extending transversely at least partially between the first and second drive chain loops, the partition movers each having first and second end portions, a first chain coupler at a first end portion of the partition mover and a second chain coupler at the second end portion of the partition mover, the first and second chain couplers each including at least one coupling insert sized for insertion into respective insert receiving openings of the first and second drive chain loops to releasably couple the partition movers to the first and second drive chain loops; and a chain driver coupled to the first and second drive chain loops and adapted to move the drive chain loops and thereby the coupled partition movers and sets of first cards engaged by the partition movers along the conveyor with the partition movers being movable from the first card receiving location to the second card insertion location, whereby the spacing between the partition movers along the drive chain loops is adjustable by spreading apart the chains, detaching the partition movers to be shifted and recoupling the partition movers to the chains at the desired spacing.

18. An apparatus according to claim 17 wherein the conveyor further includes an elongated guide including upper and lower guide portions which receive and support each set of first cards in an upright orientation as the partition card movers shift the respective sets of first cards along the conveyor, the elongated guide defining a plurality of lengthwise extending guide slots, the guide slots at the first card receiving location being of a first transverse spacing and the guide slots at the second card insertion location being of a second transverse spacing which may differ from the first transverse spacing, the guide including a transition section between the first card receiving location and the second card insertion location, the transverse spacing between the guide slots in the transition region being adjustable to transition the spacing from the first transverse spacing at the first card receiving location to the second transverse spacing at the second card insertion location in the event the first transverse spacing differs from the second transverse spacing.

19. An apparatus according to claim 18 in which the transition section of the guide comprises plural elongated individual transition sections each defining a single card guide slot, the transition sections being bendable to adjust the transverse spacing between the slots.

20. An apparatus according to claim 19 including at least one screw jack coupled to the transition sections and operable to bend the transition sections to adjust the spacing between the card guide slots.

21. An apparatus according to claim 19 in which the guide comprises plural individual guide track defining sections each defining a single elongated card slot extending from the first card receiving location to the second card insertion location.

22. An apparatus for making partitions for containers, the partitions each having a first set of first cards and a second set of second cards, the first set including at least one first card having at least one first card slot and the second set including at least one second card having at least one second card slot, the first and second sets of cards interfitting with one another at the respective first and second card slots to form a partition, the apparatus comprising:

a first card stock supplier adapted to deliver an elongated first band of first card stock forming material from a first roll of such material, the first card stock supplier including a first card stock advancer adapted to advance the first band from the first roll;

a first slot former adapted to repetitively engage the first band and cut the at least one first card slot in successive sections of the first band, each section corresponding to a portion of the first band from which a respective first card is to be formed;

at least one first band feeder adapted to selectively advance the first band past the first slot former;

a first card singulator adapted to selectively sever the sections of the first band into respective first cards;

a first card transporter adapted to receive the singulated first cards from the first card singulator at a first location and to transport the singulated first cards from the first location to a delivery location;

a card assembly station having a first card receiving location and a second card insertion location, the card assembly station including a card mover adapted to move respective sets of first cards from the first card receiving location to the second card insertion location;

a first card transferor adapted to transfer first cards from the delivery location to the first card receiving location;

a second card stock supplier adapted to provide an elongated second band of second card stock forming material from a second roll of such material, the second card stock supplier including a second card stock advancer adapted to advance the band of second card stock forming material from the second roll;

a second slot former adapted to repetitively engage the second band and cut the at least one second card slot in successive sections of the second band, each section corresponding to a portion of the second band from which a respective second card is to be formed;

at least one second band feeder adapted to selectively advance the second band past the second slot former;

a second card singulator adapted to selectively sever the sections of the second band into respective second cards and to deliver the singulated second cards to the second card insertion location at which the first and second sets of cards are combined to form the partition;

a programmed computer controller coupled to the first card stock supplier and operable to control the first card advancer, coupled to the first slot former and operable to control the first slot former to cut the first card slots, coupled to the at least one first band feeder and operable to control the advancing of the first band past the first slot former, coupled to the first card singulator and operable to control the first card singulator to control the severing of the sections of the first band into the respective first cards, coupled to the first card transporter and operable to control the first card transporter to control the transportation of the singulated first cards from the first location to the delivery location, coupled to the first card transferor to control the delivery of sets of first cards from the delivery location to the first card receiving location, coupled to the card mover and operable to control the moving of sets of first cards from the first card receiving location to the second card insertion location, coupled to the second card stock supplier and operable to control the second card advancer, coupled to the second slot former and operable to control the second slot former to cut the second card slots, coupled to the at least one second band feeder and operable to control the advancing of the second band past the second slot former, coupled to the second card singulator and operable to control the severing of the sections of the second band into the respective second cards and to control the delivery of singulated second cards to the second card insertion location, whereby the computer controller is operable to control the production of completed partitions;

a first sensor positioned to sense the insertion of first cards into the first card transporter at the first location and for producing a first sensor output indicating the presence of a first card received by the first card transporter at the first location;

a second sensor positioned to sense the delivery of first cards by the first card transferor from the delivery location to the first card receiving location and for producing a second sensor output signal upon detection of a failure to deliver a first card from the delivery location to the first card receiving location;

a third sensor for detecting the receipt of first cards at a first card receiving location and for producing a third sensor output signal in the event the first card transferred from the delivery location to the first card receiving location is determined not to have been fully received at the first card receiving location;

a fourth sensor positioned to detect the insertion of a second card into the set of first cards at the second card insertion location and for producing a fourth output signal indicating the failure of a second card to be inserted into the set of first cards at the second card insertion location; and the controller being coupled to the respective first, second, third and fourth sensors for receiving the first, second, third, and fourth sensor output signals, the controller selectively interrupting the operation of the apparatus in response to the first, second, third and fourth output signals.

23. An apparatus according to claim 22 wherein the first and second card stock advancers are each driven by a respective first and second stock delivery motor, wherein the at least one first band feeder includes a first band feeder motor, the at least one second band feeder includes a second bard feeder motor, wherein the first card transporter includes a first card transporter drive motor, and wherein the card mover includes a card mover drive motor, each of the first and second stock delivery motors, first and second band feeder motors, transporter drive motor, and card mover drive motor including a respective fault output indicating a fault condition, the controller being coupled to each of the fault outputs and being responsive to a fault signal at any as such outlets to selectively interrupt the operation of the apparatus.

24. An apparatus according to claim 23 in which the fault signals correspond to current overload, temperature overload and overspeed conditions of the associated motor.

25. An apparatus according to claim 23 in which the first and second stock delivery motors each comprise a variable frequency drive motor, wherein the first and second band feeder motors each comprise a servo motor operable in response to a control signal from the controller to cause the respective first and second band feeders to advance the first and second bands of material;

wherein the first card transporter includes a transporter drive clutch brake operable in response to a control signal from the controller to couple the first card transporter drive motor to the first card transporter to transport the singulated first cards from the first location to the delivery location; and wherein the card mover drive motor comprises a servo motor operable in response to a signal from the controller to move the respective sets of first cards from the first card receiving location to the second card insertion location.

26. An apparatus according to claim 24 wherein the first and second slot formers each include a slot cutter, a slot drive motor and a clutch brake operable in response to a signal from the controller to cause the slot drive motor to operate the slot cutter to cut the respective first and second slots; and wherein the first and second card singulators each include a respective singulator motor, a clutch brake, and a knife blade coupled to the motor by the clutch brake, the clutch brake being operable in response to respective signals from the controller to couple the singulator drive motor to the knife blade to cause the operation of the knife blade to sever the respective first and second bands of material into the respective first and second cards.

27. An apparatus according to claim 26 in which the first and second card stock suppliers each include a plurality of sensors and are adapted to deliver the respective first and second bands of material in a festoon prior to reaching the first and second slot formers, the sensors being positioned to detect the size of the festoon and produce festoon size indicating output signals, the controller being responsive to the festoon size output signals to vary the rate of operation of the respective first and second card stock advancers in response to the size of the festoon.

28. An apparatus for making partition cards from an elongated band of card forming material comprising:

a slot former positioned to receive the band of material, the slot former including a slot cutter adapted to selectively engage sections of the card forming material, each section corresponding to a portion of the band of material from which a single card is to be formed, a slot cutter actuator coupled to the slot cutter and adapted to control the engagement of the slot cutter with the sections of the band of material;

a singulator including a knife and a knife actuator, the knife actuator being adapted to selectively move the knife into engagement with the band of material to sever the sections and thereby the individual cards from the band of material;

a transporter including a plurality of card holders the transporter including a transporter driver adapted to shift individual card holders into a card receiving position to receive individual cards from the singulator and to shift card holders which contain cards to a card transfer location;

at least one card material feeder adapted to engage the band of material and to advance the band of material through the slot former and to position cards into the card holders;

a card transferor adapted to engage and transfer sets of card from the card holders at the card transfer location to a card delivery location from which the sets of cards are delivered from the apparatus, each set of cards including at least one of the individual cards, and a card transferor actuator adapted to cause the card transferor to transfer the sets of cards from the card transfer location to the card delivery location; and a programmed controller coupled to the slot cutter actuator, to the at least one card material feeder, to the knife actuator, to the transporter and to the card transferor, the controller being programmed to control the at least one card material feeder to advance each section of the elongated band of card forming material which is to form a single card in position for slotting by the slot former, the controller being programmed to actuate the slot cutter actuator to cause the slot cutter to form the slots in each section when in position for slotting, the controller being programmed to control the operation of the transporter driver to position an empty card holder in the card receiving position to receive individual cards severed by the knife, the controller being programmed to control the at least one card material feeder to position respective cards into the respective card holders, the controller being programmed to control the operation of the transporter driver to shift card containing holders from the card receiving position to the card transfer position, and the controller being programmed to control the card transferor to transfer the sets of cards from the card transfer location to the card delivery location.

29. An apparatus according to claim 28 wherein the at least one card material feeder comprises at least one card material feeder positioned between the slot former and the singulator, the controller being programmed to cause the at least one card material feeder to advance respective sections of the band of material through the slot former and into a respective card holder prior to severing of the section from the band of material.

30. An apparatus according to claim 29 including a card detector for detecting the presence of the respective sections of the band of material in the respective card holders and for providing a card presence signal indicating the presence of a section of the band of material in a card holder, the controller being adapted to receive the card presence signals and to interrupt the operation of the apparatus in the event a card presence signal is not received prior to the time the knife actuator is actuated to sever a card from the band.

31. An apparatus according to claim 28 including a frame, the slot former, singulator, transporter, at least one card material feeder and card transferor being carried by the frame, the frame being supported by wheels for rolling in a first direction.

32. An apparatus according to claim 28 in which the at least one card material feeder comprises first and second elongated rotatable rollers defining a nip therebetween, the band of material passing through the nip and being driven by the rollers as the rollers rotate, the rollers each having a plurality of spaced apart elongated lands extending along the length of the rollers, the lands of the first roller being aligned with the lands of the second roller as the rollers rotate with the nip being defined between adjacent lands, and a motor controlled by the controller to selectively rotate at least one of the first and second rollers.

33. An apparatus according to claim 32 in which the rollers comprise elongated gears with a plurality of elongated teeth and wherein the lands are formed by removing material from the teeth.

34. An apparatus according to claim 28 in which the knife includes a knife blade which extends transversely across the band of material, the knife actuator comprising first and second spaced apart knife supporting arms coupled to the knife, the knife supporting arms being supported for reciprocation and positioned such that the knife blade severs one of the sections into a card as the knife supporting arms reciprocate, the knife actuator including an eccentric coupled to the knife supporting arms so as to reciprocate the knife supporting arms upon rotation of the eccentric, a motor, a clutch brake controlled by the controller so as to selectively couple the motor to the eccentric to drive the eccentric and reciprocate the knife supporting arms.

35. An apparatus according to claim 28 in which the transporter comprises first and second spaced apart rotatable card holder support wheels each having a periphery, the transporter drive including a transporter drive shaft, a transporter drive motor, a first endless transporter drive loop coupled to the transporter drive shaft and to the first card holder support wheel and a second endless drive loop coupled to the transporter drive shaft and to the second card holder support wheel, the card holders each comprising a set of first and second card supports positioned to extend at least in part in a transverse direction between the first and second drive loops, a card receiving opening being provided between the first and second card supports of the set and extending in the transverse direction, a plurality of sets of first and second card supports being coupled to the first and second drive loops at spaced locations along the drive loops, the controller selectively coupling the motor to the drive shaft to advance the first and second drive loops to position a set of first and second card supports and thereby the card receiving opening and card holder in the card receiving position, and to advance card containing holders to the card transfer location, the first and second card supports being positioned on the first and second card holder support wheels such that a majority of each card in a card holder is positioned inwardly of the periphery of the card holder support wheels.

36. An apparatus according to claim 35 in which the first and second card supports each comprise a resilient tube and at least one card gripper mounted to each tube.

37. An apparatus according to claim 35 in which the card transferor comprises a support, a plurality of sets of card transfer rollers rotatably carried by the support, each set of card transfer rollers including a first roller and a second roller which define a card transfer nip therebetween, a card transfer roller driver coupled to the sets of rollers so as to drive each set of rollers so as to transfer cards engaged by the sets of rollers in a first direction through the card transfer nips of the sets of rollers, a card transfer roller support mover controlled by the controller to selectively move the sets of rollers into position to engage cards at the card transfer location in the card transfer nips, whereby the engaged cards are transferred to the card delivery location, the card transferor including only one set of first and second rollers for each card to be engaged and transferred in the first direction.

38. An apparatus according to claim 28 including a card transfer sensor positioned to sense the presence of a card in a card holder that should have been transferred by the card transferor, the card transfer sensor producing a card transfer error output signal upon the detection of such a card, the controller interrupting the operation of the apparatus in response to the card transfer error output signal.

39. An apparatus according to claim 28 including a frame which is supported by wheels to permit rolling of the frame in a first direction, the apparatus including a guide positioned to guide the motion of the wheels in the first direction, and in which the slot former, at least one card material feeder, singulator, transporter and card transferor are each carried by the frame, whereby the position of the frame is adjustable in the first direction.

40. An apparatus for making partition cards from an elongated band of card forming material comprising:

a slot former positioned to receive the band of material, the slot former including a slot cutter adapted to selectively engage sections of the card forming material, each section corresponding to a portion of the band of material from which a single card is to be formed, a slot cutter actuator coupled to the slot cutter and adapted to control the engagement of the slot cutter with the sections of the band of material;

a singulator including a knife and a knife actuator, the knife actuator being adapted to selectively move the knife into engagement with the band of material to sever the sections and thereby the individual cards from the band of material;

a transporter including a plurality of card holders the transporter including a transporter driver adapted to shift individual card holders into a card receiving position to receive individual cards from the singulator and to shift card holders which contain cards to a card transfer location;

at least one card material feeder adapted to engage the band of material and to advance the band of material through the slot former and to position cards into the card holders;

a card transferor adapted to engage and transfer sets of card from the card holders at the card transfer location to a card delivery location from which the sets of cards are delivered from the apparatus, each set of cards including at least one of the individual cards, and a card transferor actuator adapted to cause the card transferor to transfer the sets of cards from the card transfer location to the card delivery location; and a programmed controller coupled to the slot cutter actuator, to the at least one card material feeder, to the knife actuator, to the transporter and to the card transferor, the controller being programmed to control the at least one card material feeder to advance each section of the elongated band of card forming material which is to form a single card in position for slotting by the slot former, the controller being programmed to actuate the slot cutter actuator to cause the slot cutter to form the slots in each section when in position for slotting, the controller being programmed to control the operation of the transporter driver to position an empty card holder in the card receiving position to receive individual cards severed by the knife, the controller being programmed to control the at least one card material feeder to position respective cards into the respective card holders, the controller being programmed to control the operation of the transporter driver to shift card containing holders from the card receiving position to the card transfer position, and the controller being programmed to control the card transferor to transfer the sets of cards from the card transfer location to the card delivery location; and wherein the at least one card material feeder comprises first and second elongated rotatable rollers defining a nip therebetween, the band of material passing through the nip and being driven by the rollers as the rollers rotate, the rollers each having a plurality of spaced apart elongated lands extending along the length of the rollers, the lands of the first roller being aligned with the lands of the second roller as the rollers rotate with the nip defined by the spacing between adjacent lands, and a motor controlled by the controller to selectively rotate at least one of the first and second rollers.

41. A method of operating an apparatus which makes partition cards from a band of partition card forming material, the method comprising:

a) moving a first card holder to a first position;

b) positioning a section of the band of material into the first card holder in the first position;

c) severing the section of material from the band to provide an individual card in the first card holder in the first position;

d) moving the first card holder to a second position and positioning a second card holder in the first position;

e) positioning a section of the band of material into the second card holder in the first position;

f) severing the section of material from the band to provide an individual card in the second card holder in the first position;

g) moving the second card holder to the second position, the first card holder to a third position, and positioning a third card holder in the first position;

h) repeating the acts of paragraphs a) through g);

i) interrupting the acts of paragraphs a) through g) in the event a section of the band of material is not positioned in a card holder at the first position prior to severing the section of material from the band.

42. A method according to claim 41 comprising:

moving the card containing holder to a transfer location;

transferring a set of cards, the set containing at least one card, from the card transfer location to a card delivery location; and determining whether any cards of the set have not been transferred from the card transfer location to the card delivery location and interrupting the operation of the apparatus in the event any cards of the set are determined as not having been transferred from the card transfer location to the card delivery location.

43. An apparatus for making partition cards from an elongated band of card forming material comprising:

means for forming slots in sections of the card forming material, each section corresponding to a portion of the band of material from which a single card is to be formed;

singulator means for severing the sections and thereby the individual cards from the band of material;

transporter means for receiving individual cards from the singulator means and for shifting the received cards to a card transfer location;

card material feeder means for engaging the band of material and advancing the band of material through the slot former means and into the transporter means;

card transferor means for engaging and transferring sets of card from the transporter means at the card transfer location and for transferring such sets of cards to a card delivery location with the sets of cards being in an upright orientation at the card delivery location, each set of cards including at least one of the individual cards; and a programmed controller means coupled to the slot forming means, to the card material feeder means, to the singulator means, to the transporter means and to the card transferor means, the controller means comprising means for controlling the card material feeder means to advance each section of the elongated band of card forming material which is to form a single card in position for slotting by the slot former means, for controlling the slot forming means to form the slots in each section when in position for slotting, for controlling the transporter means to receive individual cards, for controlling the card material feeder means to position respective cards into the transporting means, for controlling the transporter means to shift cards, to the card transfer position, and for controlling the card transferor to transfer the sets of cards from the card transfer location to the card delivery location.

44. A card stock forming material supplier for delivering an elongated band of partition card forming material from a roll of such card forming material comprising:

a roll carrier adapted to rotatably carry a roll of card forming material;

a card forming material advancer adapted to rotate the roll to deliver the elongated band of card forming material from the roll;

first and second band supports each adapted to support the elongated band of card forming material, the band of card forming material being delivered from the second support to a downstream location;

the card forming material advancer rotating the roll at a variable rate to provide a festoon of card forming material extending downwardly between the first and second band supports;

a plurality of festoon sensors each positioned at a different elevation and adapted to sense the presence of the festoon at the elevation of the sensor, each sensor providing a sensor output signal indicating the sensing of the festoon by the sensor; and the material advancer including a controller responsive to the sensor output signals and adapted to control the rate of delivery of the elongated band in response to the sensor output signals; and including at least four such sensors, the first sensor being at a first elevation, the second sensor being at a second elevation below the first elevation, the third sensor being at a third elevation below the second elevation and the fourth sensor being at a fourth elevation below the third elevation, whereby detection of the festoon by the fourth sensor indicates a festoon which is larger than a festoon detected by any of the first, second and third sensors and not by the fourth sensor, whereby detection of the festoon by the third sensor indicates a festoon which is larger than a festoon which is detected by any of the first and second sensors and not by any of the third and fourth sensors, whereby detection of the festoon by the second sensor indicates a festoon which is larger than a festoon which is detected by the first sensor and not by any of the second, third and fourth sensors, the controller being operable to control the rate of delivery of the elongated band at a first rate in the event the festoon is detected by the second sensor and not by any of the third and fourth sensors, at a second rate which is greater than the first rate in the event the festoon is detected by the first sensor and not by any of the second, third and fourth sensors, at a third rate which is less than the first rate in the event the festoon is detected by the third sensor and not by the fourth sensor, and at a rate which halts the delivery of the elongated band of material in the event the festoon is detected by the fourth sensor.

45. A card stock forming material supplier according to claim 44 in which the second rate is about two times the first rate and the third rate is about one-half the first rate.

46. A card stock forming material supplier for delivering an elongated band of partition card forming material from a roll of such card forming material comprising:

a roll carrier adapted to rotatably carry a roll of card forming material;

a card forming material advancer adapted to rotate the roll to deliver the elongated band of card forming material from the roll;

first and second band supports each adapted to support the elongated band of card forming material, the band of card forming material being delivered from the second support to a downstream location;

the card forming material advancer rotating the roll at a variable rate to provide a festoon of card forming material extending downwardly between the first and second band supports;

a plurality of festoon sensors each positioned at a different elevation and adapted to sense the presence of the festoon at the elevation of the sensor, each sensor providing a sensor output signal indicating the sensing of the festoon by the sensor; and the material advancer including a controller responsive to the sensor output signals and adapted to control the rate of delivery of the elongated band in response to the sensor output signals; and including at least three such sensors, the first sensor being at a first elevation, the second sensor being at a second elevation below the first elevation and the third sensor being at a third elevation below the second elevation, whereby detection of the festoon by the third sensor indicates a festoon which is larger than a festoon which is detected by any of the first and second sensors and not by the third sensor, and whereby detection of the festoon by the second sensor indicates a festoon which is larger than a festoon which is detected by the first sensor and not by the second sensor, the controller being operable to control the rate of delivery of the elongated band at a first rate in the event the festoon is detected by the second sensor and not by the third sensor, at a second rate which is greater than the first rate in the event the festoon is detected by the first sensor and not by the second sensor, and at a third rate which is less than the first rate in the event the festoon is detected by the third sensor.

47. A card stock forming material supplier according to claim 46 in which the second rate is about two times the first rate and the third rate is about one-half the first rate.

48. A method for controlling the delivery of an elongated band of card stock material from a roll of such material for use in making container partitions from the elongated band, the method comprising:

delivering elongated partition card stock forming material from a roll of such material to form a hanging festoon of such material;

detecting the size of the festoon;

varying the rate of delivery of the material depending upon the size of the festoon, wherein the step of varying the rate of delivery comprises the step of delivering the material at a first rate of delivery in the event the festoon is of a first size, delivering the material at a second rate which is greater than the first rate in the event the festoon is of a second size less than the first size, and delivering the material at a third rate which is less than the first rate in the event the festoon is of a third size greater than the first size.

49. A method of controlling the delivery of an elongated band of card stock material according to claim 48 comprising interrupting the delivery of the material in the event the size of festoon exceeds a maximum threshold size which is greater than the third size.

50. A method according to claim 48 in which the act of detecting the size of the festoon comprises the act of determining the extent to which the festoon extends downwardly.

51. A method according to claim 48 in which the step of varying the rate of delivery of the material comprises the act of varying the frequency of drive signals provided to a variable frequency drive motor to vary the rate of operation of the motor to thereby vary the rate of delivery of the material.

52. A method according to claim 48 comprising the act of intermittently advancing material from the festoon of material while continuously delivering material to the festoon at a variable rate unless the act of delivering the material is interrupted.

53. A card stock forming material supplier for delivering an elongated band of partition card forming material from a roll of such card forming material comprising:

a roll carrier adapted to rotatably carry a roll of card forming material; a card forming material advancer adapted to rotate the roll to deliver the elongated band of card forming material from the roll;

first and second band supports each adapted to support the elongated band of card forming material, the band of card forming material being delivered from the second support to a downstream location;

the card forming material advancer rotating the roll at a variable rate to provide a festoon of card forming material extending downwardly between the first and second band supports;

a plurality of festoon sensors each positioned at a different elevation and adapted to sense the presence of the festoon at the elevation of the sensor, each sensor providing a sensor output signal indicating the sensing of the festoon by the sensor;

the material advancer including a controller responsive to the sensor output signals and adapted to control the rate of delivery of the elongated band in response to the sensor output signals;

wherein the apparatus includes at least three such sensors, the first sensor being at a first elevation, the second sensor being at a second elevation below the first elevation and the third sensor being at a third elevation below the second elevation, whereby detection of the festoon by the third sensor indicates a festoon which is larger than a festoon which is detected by any of the first and second sensors and not by the third sensor, and whereby detection of the festoon by the second sensor indicates a festoon which is larger than a festoon which is detected by the first sensor and not by the second sensor, the controller being operable to control the rate of delivery of the elongated band at a first rate in the event the festoon is detected by the second sensor and not by the third sensor, at a second rate which is greater than the first rate in the event the festoon is detected by the first sensor and not by the second sensor, and at a third rate which is less than the first rate in the event the festoon is detected by the third sensor; and wherein the advancer includes first and second material feed rolls which form a nip therebetween, the elongated band of material passing through the nip, at least one of the first and second material feed rolls being rotatable to pull the elongated band from the roll and rotate the roll as the band is pulled from the roll, a computer controlled motor adapted to drive the rotation of said at least one of the first and second feed rolls, the controller comprising a programmed computer coupled to the sensors for receiving the sensor output signals and to the motor for controlling the operation of the motor in response to the sensor output signals.

54. A card stock material supplier according to claim 53 in which the second rate is about two times the first rate and the third rate is about one-half the first rate.

55. A card stock material supplier according to claim 54 in which the motor comprises a variable frequency motor.

56. A card stock material supplier according to claim 55, including a fourth sensor positioned below the third sensor, the controller controlling the operation of the motor to halt the delivery of the material to the festoon in the event the festoon is detected by the fourth sensor.

57. A conveyor for moving a set of first partition cards, each set containing at least one first card, from a first card receiving location to a second card insertion location at which second cards are inserted into the first set of cards, the conveyor comprising:

an elongated conveyor frame having a longitudinal or lengthwise axis;

first and second spaced apart elongated endless drive chain loops extending lengthwise along the frame, each drive chain loop being comprised of a plurality of interconnected chain links with the links including insert receiving openings, at least one of the drive chain loops being movable in a transverse direction so as to permit spreading apart of the drive chain loops, a plurality of spaced apart partition movers extending transversely at least partially between the first and second drive chain loops, the partition movers each having first and second end portions, a first chain coupler at a first end portion of the partition mover and a second chain coupler at the second end portion of the partition mover, the first and second chain couplers each including at least one coupling insert sized for insertion into respective insert receiving openings of the first and second drive chain loops to releasably couple the partition movers to the first and second drive chain loops; and a chain driver coupled to the first and second drive chain loops and adapted to move the drive chain loops thereby the coupled partition movers and sets of first cards engaged by the partition movers along the conveyor with the partition movers being movable from the first card receiving location to the second card insertion location, whereby the spacing between the partition movers along the drive chain loops is adjustable by spreading apart the chains, detaching the partition movers to be shifted and recoupling the partition movers to the chains at the desired spacing.

58. A conveyor for moving a set of first partition cards according to claim 57 having an elongated guide including upper and lower guide portions which receive and support each set of first cards in an upright orientation as the partition card movers shift the sets of first cards along the conveyor, the elongated guide defining a plurality of lengthwise extending guide slots, the guide slots at the first card receiving location being of a first transverse spacing and the guide slots at the second card insertion location being of a second transverse spacing which may differ from the first transverse spacing, the guide including a transition section between the first card receiving location and the second card insertion location, the spacing between the guide slots in the transition region being adjustable to transition the spacing from the first transverse spacing at the first card receiving location to the second transverse spacing at the second card insertion location in the event the first transverse spacing differs from the second transverse spacing.

59. A conveyor according to claim 58 in which the transition region of the guide comprises plural elongated transition sections each defining a single card guide slot, the transition sections being bendable to adjust the transverse spacing between the slots.

60. A conveyor according to claim 59 including at least one screw jack coupled to the transition sections and operable to bend the transition sections to adjust the spacing between the card guide slots.

61. A conveyor according to claim 58 in which the guide comprises plural guide individual track defining sections each defining a single elongated card slot extending from the first card receiving location to the second card insertion location.

* * * * *